US005291862A

United States Patent [19]

Katoh et al.

[11] Patent Number: 5,291,862

[45] Date of Patent: Mar. 8, 1994

[54] CYLINDER SLEEVE ASSEMBLY USED IN CYLINDER BLOCK FOR MULTI-CYLINDER INTERNAL COMBUSTION ENGINE, AND FORMING MOLD FOR USE IN PRODUCTION OF SAND MOLD FOR CASTING THE SAME

[75] Inventors: Hisashi Katoh, Saitama; Akio Simizu, Mie; Shigeo Abe, Saitama; Hiroshi Udagawa, Saitama; Kiichiro Susa, Saitama, all of Japan

[73] Assignee: Honda Giken Kogyo Kabushiki Kaisha, Tokyo, Japan

[21] Appl. No.: 289

[22] Filed: Jan. 4, 1993

[30] Foreign Application Priority Data

Jan. 9, 1992 [JP] Japan ..... 4-413 [U]
Jan. 9, 1992 [JP] Japan ..... 4-2473

[51] Int. Cl.[5] ..... F01B 11/02
[52] U.S. Cl. ..... 123/193.2; 29/888.061
[58] Field of Search ..... 123/193.2; 29/888.06, 29/888.061, DIG. 5, DIG. 10

[56] References Cited

U.S. PATENT DOCUMENTS 1,896,098 2/1933 Poyer ..... 123/193.2
2,126,089 9/1938 Brown ..... 123/193.2
3,112,541 12/1963 Bohm et al. .
3,276,082 10/1966 Thomas .
4,023,613 5/1977 Uebayasi et al. .
4,903,652 2/1990 Field et al. ..... 123/193.2
5,005,469 4/1991 Ohta ..... 29/888.061

FOREIGN PATENT DOCUMENTS 363844 4/1990 European Pat. Off. .

OTHER PUBLICATIONS

Patent Abstracts of Japan, vol. 10, No. 342(M-536), Nov. 19, 1986, Abstract of JP 61-142349(A) Jun. 1986.

*Primary Examiner*—Tony M. Argenbright
*Assistant Examiner*—M. Macy
*Attorney, Agent, or Firm*—Lyon & Lyon

[57] ABSTRACT

In a cylinder sleeve assembly comprising a plurality of cylinder sleeves whose adjacent cylindrical peripheral walls are coupled to each other, a plurality of sink mark inhibiting projections biting into the cylinder sleeve assembly during casting a cylinder block are provided in each of valley-like areas of an outer peripheral surface of the cylinder sleeve assembly which are located on opposite sides of a coupled portion of the adjacent peripheral walls. Thus, the adhesion between the cylinder barrel assembly and the cylinder sleeve assembly is enhanced. In addition, the adhesion is further enhanced by providing a predetermined inclination to each of the sink mark inhibiting projections.

23 Claims, 31 Drawing Sheets

CYLINDER SLEEVE ASSEMBLY USED IN CYLINDER BLOCK FOR MULTI-CYLINDER INTERNAL COMBUSTION ENGINE, AND FORMING MOLD FOR USE IN PRODUCTION OF SAND MOLD FOR CASTING THE SAME

BACKGROUND OF THE INVENTION

1. Field of the Invention

The present invention generally relates to a cylinder sleeve assembly used in a cylinder block for a multi-cylinder internal combustion engine, and more particularly, a cylinder sleeve assembly cast in a cylinder barrel assembly in a cylinder block for a multi-cylinder internal combustion engine, and a mold for use in production of sand mold for casting the cylinder sleeve assembly.

2. Description of the Prior Art

There is such a conventionally known cylinder sleeve assembly including a plurality of circumferentially extending convexities arranged at predetermined distances along a generating line (see Japanese Patent Application Laid-open No. 104740/80).

One of reasons why the convexities are provided is that the contact area of the cylinder sleeve assembly is increased to enhance the adhesion of the cylinder sleeve assembly with respect to the cylinder barrel assembly. However, the convexities do not contribute to the enhancement of the adhesion of the cylinder sleeve assembly to the cylinder barrel assembly in a particular area which will be described below.

That is, if adjacent cylindrical peripheral walls of a plurality of cylinder sleeves are coupled to each other as described above, an outer peripheral surface of the cylinder sleeve assembly has valley-like areas on opposite sides of a coupled portion between the adjacent cylindrical peripheral walls.

In a mold for casting a cylinder block having a cylinder sleeve assembly of such a construction placed therein, if a molten metal is poured into a cylinder barrel assembly molding cavity defined between the cylinder sleeve assembly and a water jacket shaping core, the molten metal located a region faced by the valley-like areas tends to be solidified more slowly than the molten metal located at the other region. For this reason, a circumferential solidification/shrinkage force is applied to a valley-like area-opposed portion of the cylinder barrel assembly. However, the above-described convexities cannot oppose such solidification/shrinkage force and hence, sink marks are generated on the valley-like area-opposed portion, resulting in a deteriorated adhesion between the opposed portion and the valley-like area.

SUMMARY OF THE INVENTION

Accordingly, it is a first object of the present invention to provide a cylinder sleeve assembly in which the generation of sink marks in the valley-like area-opposed portion of the cylinder barrel assembly can be inhibited to enhance the adhesion between the opposed portion and the valley-like area.

To achieve the above object, according to a first aspect and feature of the present invention, there is provided a cylinder sleeve assembly cast in a cylinder barrel assembly in a cylinder block for a multi-cylinder internal combustion engine, comprising a plurality of cylinder sleeves whose adjacent cylindrical peripheral walls are coupled to each other, and a plurality of sink mark inhibiting engage portions provided in each of those valley-like areas of an outer peripheral surface of the cylinder sleeve assembly which are located on opposite sides of a coupled portion between the adjacent peripheral walls, the sink mark inhibiting engage portions being engaged with the cylinder barrel assembly during casting of the cylinder block.

With the above first feature of the present invention, it is possible to provide a cylinder sleeve assembly, the adhesion of which to the cylinder barrel assembly can be enhanced by employing an extremely simple measure that the plurality of sink mark inhibiting engage portions are provided in each of the valley-like areas.

In addition, according to a second aspect and feature of the present invention there is provided a cylinder sleeve assembly cast in a cylinder barrel assembly in a cylinder block for a multi-cylinder internal combustion engine, comprising a plurality of cylinder sleeves whose adjacent cylindrical peripheral walls are coupled to each other, and a plurality of sink mark inhibiting engage portions provided in each of those valley-like areas of an outer peripheral surface of the cylinder sleeve assembly which are located on opposite sides of a coupled portion between the adjacent peripheral walls, the sink mark inhibiting engage portions being engaged with the cylinder barrel assembly during casting of the cylinder block, the engage portion being formed in such a manner that a engage portion-bisecting division plane which intersects a curvature circle of the outer peripheral surface of the cylinder sleeve and extends in an axial direction of the cylinder sleeve, has a predetermined inclined angle inclined toward the coupled portion with respect to a reference plane which includes a intersection between the dividing plane and the curvature circle and the center of the curvature circle and extends in the axial direction of the cylinder sleeve.

With the second feature of the present invention, the predetermined inclination is provided to the plurality of sink mark inhibiting engage portions in each valley-like area, and therefore, it is possible for these engage portions to exhibit a sink mark inhibiting effect more significantly, thereby further enhancing the adhesion of the cylinder sleeve assembly to the cylinder barrel assembly.

It is a second object of the present invention to provide inhibit the generation of sink marks in opposite end areas of the cylinder sleeve assembly in a direction of arrangement of the cylinder sleeves to enhance the adhesion between the cylinder sleeve assembly and the cylinder barrel assembly and to provide a uniformization of the stress generated in the cylinder sleeves during cooling.

To achieve the above object, according to a third aspect and feature of the present invention, there is provided a cylinder sleeve assembly cast in a cylinder barrel assembly in a cylinder block for a multi-cylinder internal combustion engine, comprising a plurality of cylinder sleeves whose adjacent cylindrical peripheral walls are coupled to each other, a plurality of first sink mark inhibiting engage portions provided in each of those valley-like areas of an outer peripheral surface of the cylinder sleeve assembly which are located on opposite sides of a coupled portion between the adjacent peripheral walls, the first sink mark inhibiting engage portions being engaged with the cylinder barrel assembly during casting of the cylinder block, and a plurality of second sink mark inhibiting engage portions provided in opposite end areas of the outer peripheral surface of the cylinder sleeve assembly in a direction of arrangement of the cylinder sleeves, the second sink mark inhibiting engage portions being engaged with the cylinder barrel assembly during casting of the cylinder block.

With the third feature of the present invention, the sink mark inhibiting engage portions are provided not only in each of the valley-like areas, but also in the opposite end areas in the direction of arrangement of the cylinder sleeves and therefore, in addition to the above-described effect, it is possible to enhance the adhesion between the cylinder sleeve assembly and the cylinder barrel assembly and to uniformize the generation of the stress during cooling, by the sink mark inhibiting engage portions in the opposite end areas in the direction of arrangement of the cylinder sleeves.

Further, according to a fourth aspect and feature of the present invention, there is provided a cylinder sleeve assembly cast in a cylinder barrel assembly in a cylinder block for a multi-cylinder internal combustion engine, comprising a plurality of cylinder sleeves whose adjacent cylindrical peripheral walls are coupled to each other, a plurality of first sink mark inhibiting engage portions provided in each of those valley-like areas of an outer peripheral surface of the cylinder sleeve assembly which are located on opposite sides of a coupled portion between the adjacent peripheral walls, the first sink mark inhibiting engage portions being engaged with the cylinder barrel assembly during casting of the cylinder block, the first engage portion being formed in such a manner that an engage portion-bisecting division plane which intersects a curvature circle of the outer peripheral surface of the cylinder sleeve and extends in an axial direction of the cylinder sleeve, has a predetermined inclined angle inclined toward the coupled portion with respect to a reference plane which includes a intersection between the division plane and the curvature circle and the center of the curvature circle and extends in the axial direction of the cylinder sleeve, and a plurality of second sink mark inhibiting engage portions provided in opposite end areas of the outer peripheral surface of the cylinder sleeve assembly in a direction of arrangement of the cylinder sleeves, the second sink mark inhibiting engage portions being engaged with the cylinder barrel assembly during casting of the cylinder block.

With the fourth feature of the present invention, the predetermined inclination is provided to the plurality of sink mark inhibiting engage portions in each valley-like area and therefore, it is possible for these engage portions to exhibit a sink mark inhibiting effect more significantly, thereby further enhancing the adhesion of the cylinder sleeve assembly to the cylinder barrel assembly. Moreover, the sink mark inhibiting engage portions are provided not only in each of the valley-like areas, but also in the opposite end areas in the direction of arrangement of the cylinder sleeves and therefore, it is possible to enhance the adhesion between the cylinder sleeve assembly and the cylinder barrel assembly and to uniformize the generation of the stress during cooling, by the sink mark inhibiting engage portions in the opposite end areas in the direction of arrangement of the cylinder sleeves.

The cylinder sleeve assembly is produced through a casting process, but in the production of a sand mold therefor, it is impossible to release the sand mold smoothly, unless a special measure is taken between each of projection casting recesses formed in the sand mold and each of projecting portions of a forming mold for shaping such recesses, because the sink mark inhibiting projections protrude substantially in a radial direction from the cylindrical peripheral walls.

Accordingly, it is an third object of the present invention to provide a forming mold of the type described above, wherein the releasing of the sand mold having projection casting recesses can be performed smoothly.

To achieve the above object, according to a fifth aspect and feature of the present invention, there is provided a forming mold for producing a sand mold for casting a cylinder sleeve assembly comprising a plurality of cylinder sleeves whose adjacent cylindrical peripheral walls are coupled to each other, so that the cylinder sleeve assembly is cast in a cylinder barrel assembly, and a plurality of sink mark inhibiting projections provided in each of valley-like areas of an outer peripheral surface of the cylinder sleeve assembly which are located on opposite sides of a coupled portion of the adjacent peripheral walls, so as to protrude substantially in a radial direction from each of the cylindrical peripheral walls, the sink mark inhibiting projections biting into the cylinder barrel assembly during casting of the cylinder block, the forming mold further comprising a forming mold constituting section for shaping an angle inner surface of the sand mold corresponding to the valley-like area, the forming mold constituting section having a plurality of projecting portions provided thereon for shaping a plurality of projection casting recesses in the angle inner surface, the projecting portions being adapted to be released from the recesses prior to the releasing of the sand mold.

With the fifth feature of the present invention, in the forming mold used in the production of the sand mold for casting the cylinder sleeve assembly, the projecting portions are released from the corresponding projection casting recesses prior to the releasing of the sand mold having the angle inner surface and therefore, it is possible to perform the releasing of the sand mold smoothly without damaging of each of the recesses.

The above and other objects, features and advantages of the invention will become apparent from a consideration of the following description of the preferred embodiments, taken in conjunction with the accompanying drawings.

DESCRIPTION OF THE PREFERRED EMBODIMENTS

The present invention will now be described by way of preferred embodiments in connection with the accompanying drawings.

Figure 1:
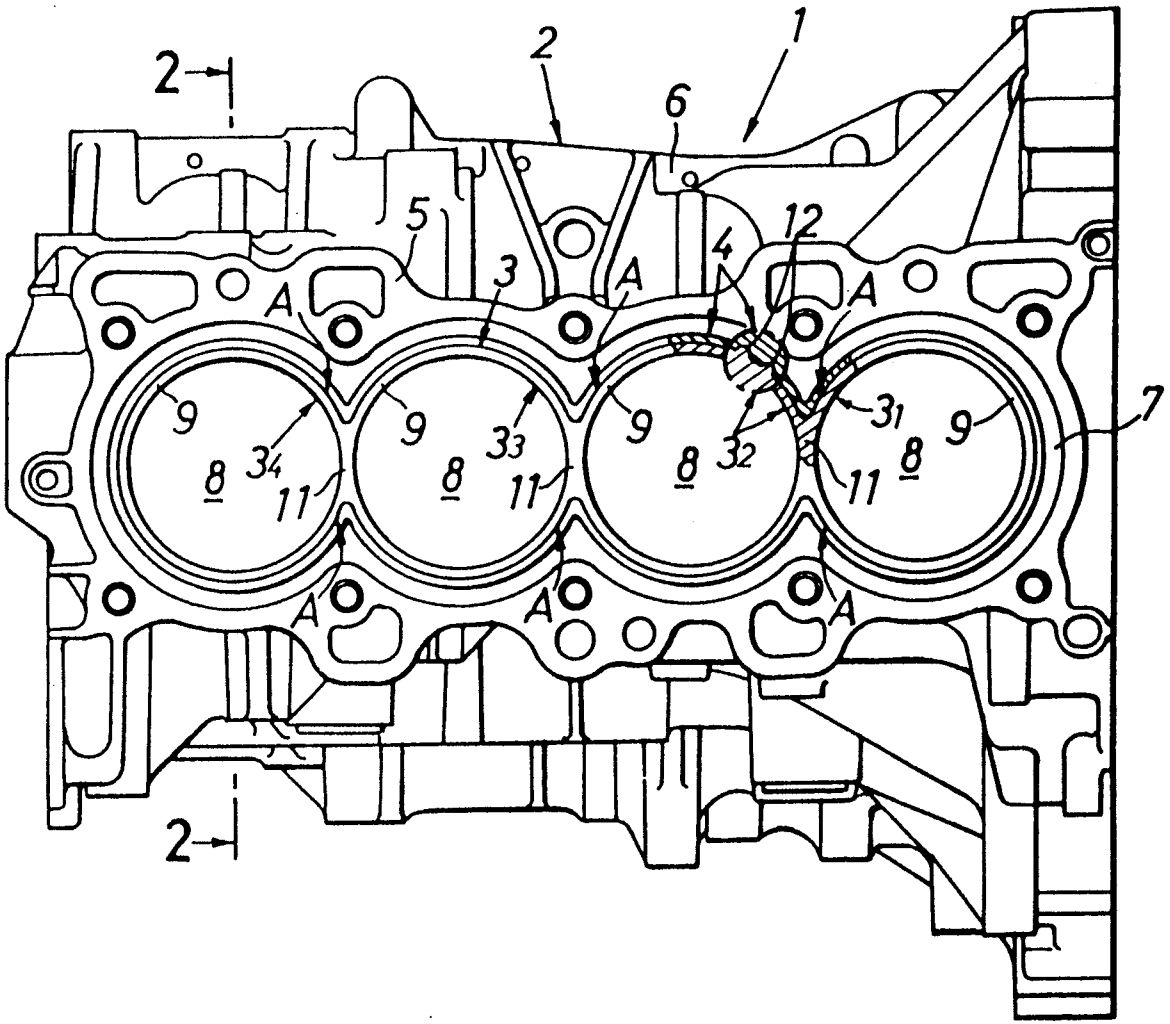
FIG. 1 is a broken plane view of an essential portion of a cylinder block.
Figure 2:
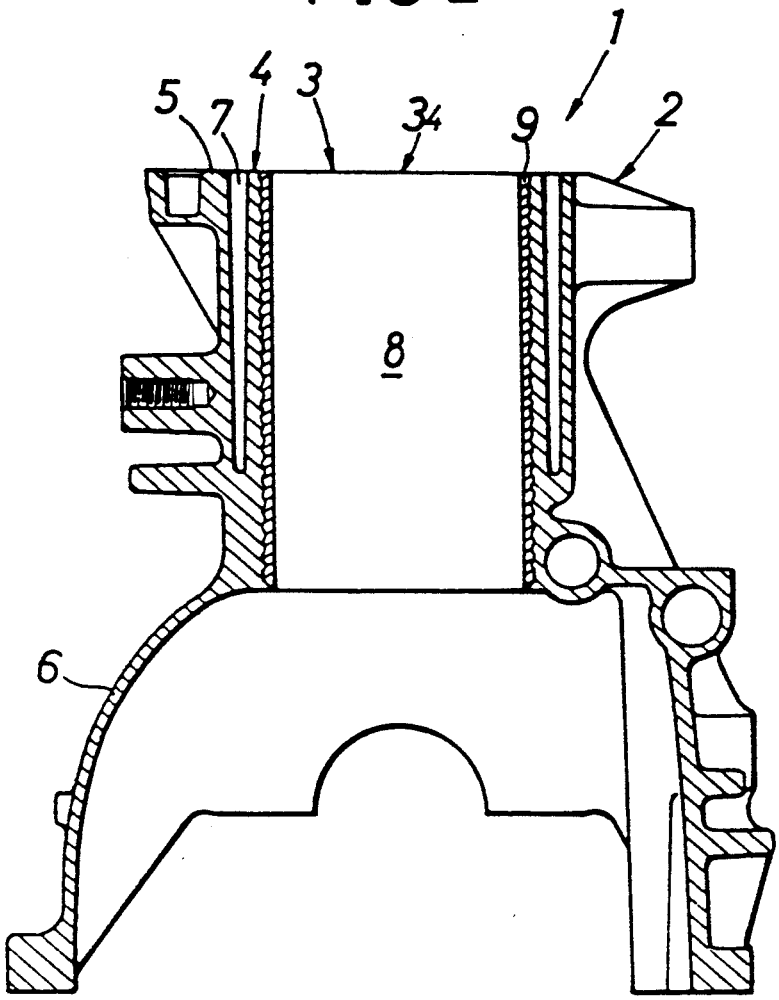
FIG. 2 is a sectional view taken along a line 2—2 in FIG. 1.

FIGS. 1 and 2 illustrate a cylinder block 1 for a serial multi-cylinder type (4-cylinder type in the illustrated embodiment) internal combustion engine. The cylinder block I is comprised of a cylinder block body 2 of an aluminum alloy and a cylinder sleeve assembly 3 of a cast iron. The cylinder block body 2 is comprised of a cylinder barrel assembly 4 with the cylinder sleeve assembly 3 filled therein in a cast-in manner, an outer wall 5 surrounding the cylinder barrel assembly 4, and a crank case 6 connected to one end of the outer wall 5. A water jacket 7 is defined between the cylinder barrel assembly 4 and the outer wall 5.

Figure 3:
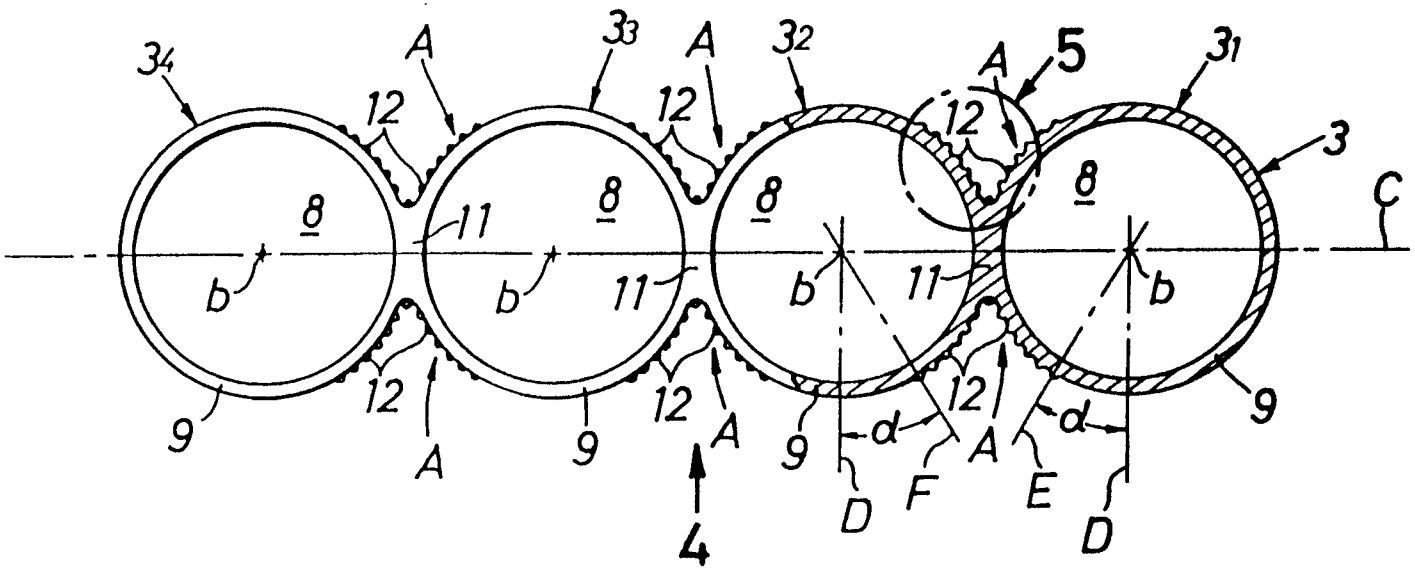
FIG. 3 is a broken plane view of an essential portion of a cylinder sleeve assembly.
Figure 4:
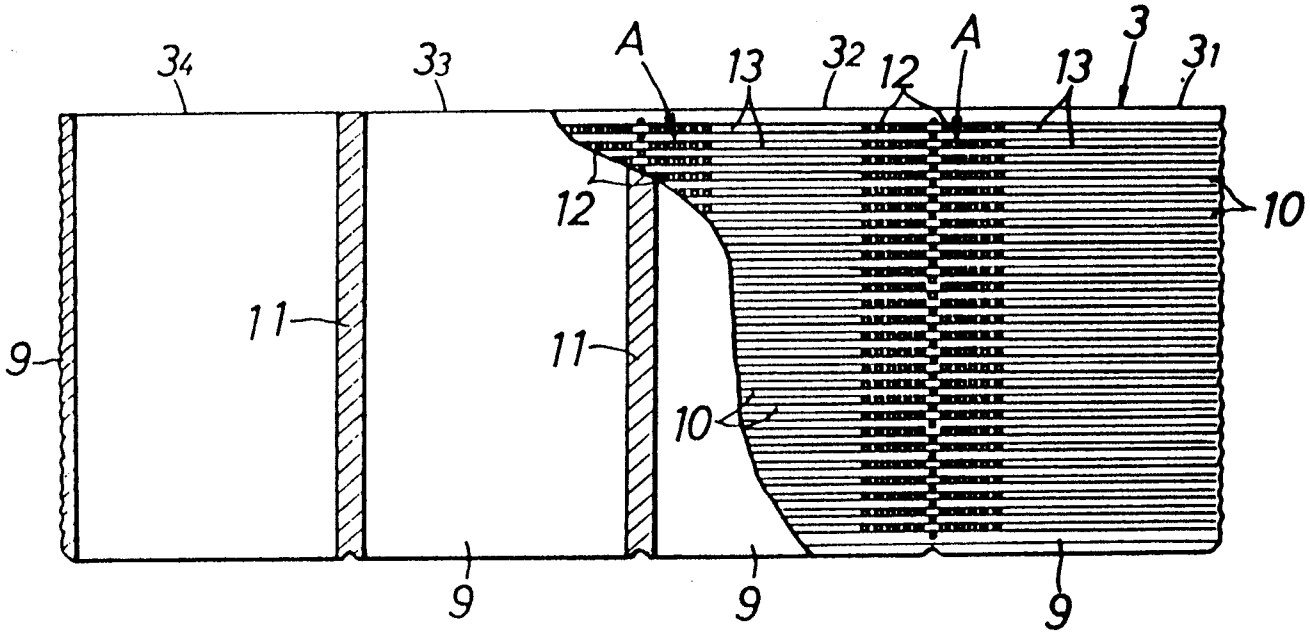
FIG. 4 is a sectional side view taken along an arrow 4 in FIG. 3.
Figure 5:
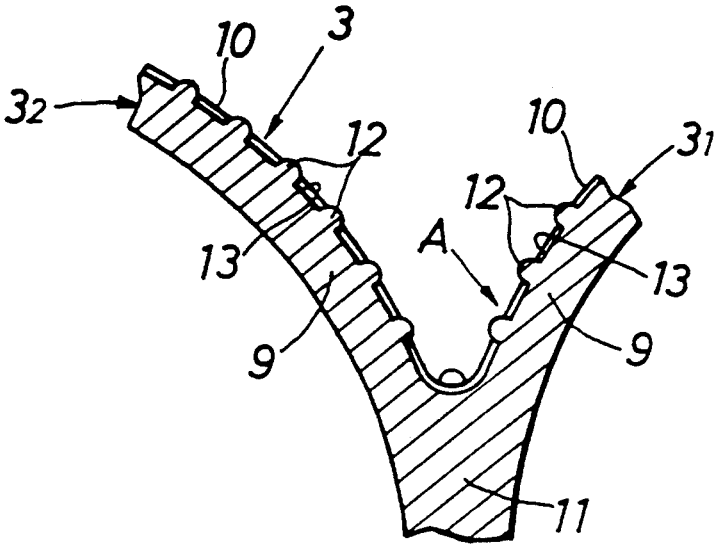
FIG. 5 is an enlarged view of an encircled portion indicated by an arrow 5 in FIG. 5.

Referring to FIGS. 3 to 5, the cylinder sleeve assembly 3 comprises a plurality of, e.g., four (in the illustrated embodiment) cylinder sleeves $3_1$, $3_2$, $3_3$ and $3_4$ arranged with center lines of their cylinder bores 8 in parallel to one another and with the adjacent cylindrical peripheral walls coupled to each other over the entire length in a direction of the generating line.

A plurality of circumferentially extending convexities 10 are arranged around an outer peripheral surface of a peripheral wall 9 of each of the cylinder sleeves $3_1$, $3_2$, $3_3$ and $3_4$ at predetermined distances over the substantially entire length in the direction of the generating line. These convexities 10 are provided for the purpose of preventing the slip-out of the cylinder sleeve assembly 3 from the cylinder barrel assembly 4 and enhancing the adhesion between the cylinder barrel assembly 4 and the cylinder sleeve assembly 3 by increasing the contact area of the cylinder sleeve assembly 3.

A plurality of projections 12 for inhibiting sink marks biting into the cylinder barrel assembly 4 during casting of the cylinder block 1 are provided on the outer peripheral surface of the cylinder sleeve assembly 3 in a valley-like area A located on opposite sides of the coupled portion of the adjacent cylindrical peripheral walls 9, in such a manner that they are located in each of concavities 13 adjoining the convexities 10. The projections 12 project substantially in a radial direction from a bottom surface of each of the concavities 13 at a predetermined distance spaced apart from the adjacent projection. A tip or leading end of each of the projections 12 is located more radially outwardly than each of the convexities 10. These projections 12 are formed simultaneously with casting of the cylinder sleeve assembly 3.

Here, the valley-like area A is defined as follows.

As best shown in FIG. 3, if an inclined plane in one of the adjacent cylinder sleeves 3, displaced through about 30° as a center angle $\alpha$ of the cylinder bore toward the coupled portion 11 from a vertical plane D including a center line b of the cylinder bore 8 and perpendicular to a plane C including a center line b of the cylinder bore 8 is represented by E, and an inclined plane in the other cylinder sleeve $3_2$ defined as being displaced toward such coupled portion 11 in the same manner as is the inclined plane E is represented by F, an extent from the one inclined plane E via the coupled portion 1 to the other inclined plane F is the valley-like area A.

Figure 6:
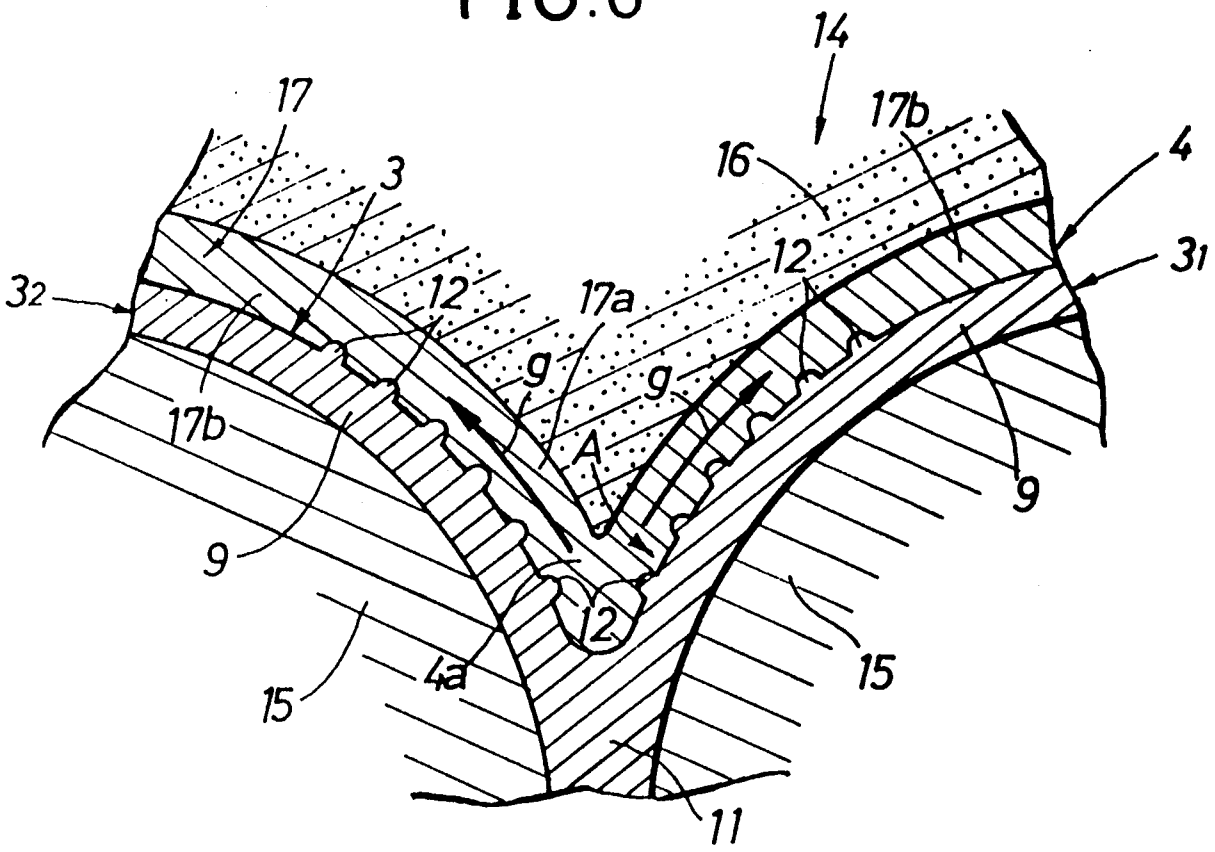
FIG. 6 is a cross-sectional plan view of an essential portion of a mold for casting a cylinder block.

As shown in FIG. 6, in a cylinder block casting mold 14, a bore pin 15 is fitted into each of the cylinder sleeves $3_1$, $3_2$, $3_3$ and $3_4$ of the cylinder sleeve assembly 3, and a water jacket shaping core 16 is disposed around the outer periphery of the cylinder sleeve assembly 3 and has an inner peripheral surface extending along the outer peripheral surface of the cylinder sleeve assembly 3. This defines a cylinder barrel assembly shaping cavity 17 between the cylinder sleeve assembly 3 and the core 16.

In producing a cylinder block 1 in a casting process, when a molten metal consisting of an aluminum alloy is poured into the cavity 17 the molten metal located at a place 17*a* faced by the valley-like area tends to be solidified more slowly than the molten metal located at another place 17*b*.

For this reason, opposite directed and circumferential solidification/shrinkage forces are applied respectively to opposite sides of a V-shaped portion 4*a* of the cylinder barrel assembly 4 opposed to the valley-like area A, as shown by two arrows g. However, the projections 12 biting into the V-shaped portion 4*a* oppose such solidification/shrinkage forces and hence, the generation of sink marks in the V-shaped portion 4*a* is inhibited. In this case, each of the projections 12 is directed substantially in the radial direction and hence, exhibits a large opposing force against the solidification and shrinkage forces.

In this way, it is possible to enhance the adhesion between the V-shaped portion 4*a* of the cylinder barrel assembly 4 and the valley-like area A of the cylinder sleeve assembly 3.

Figure 7:
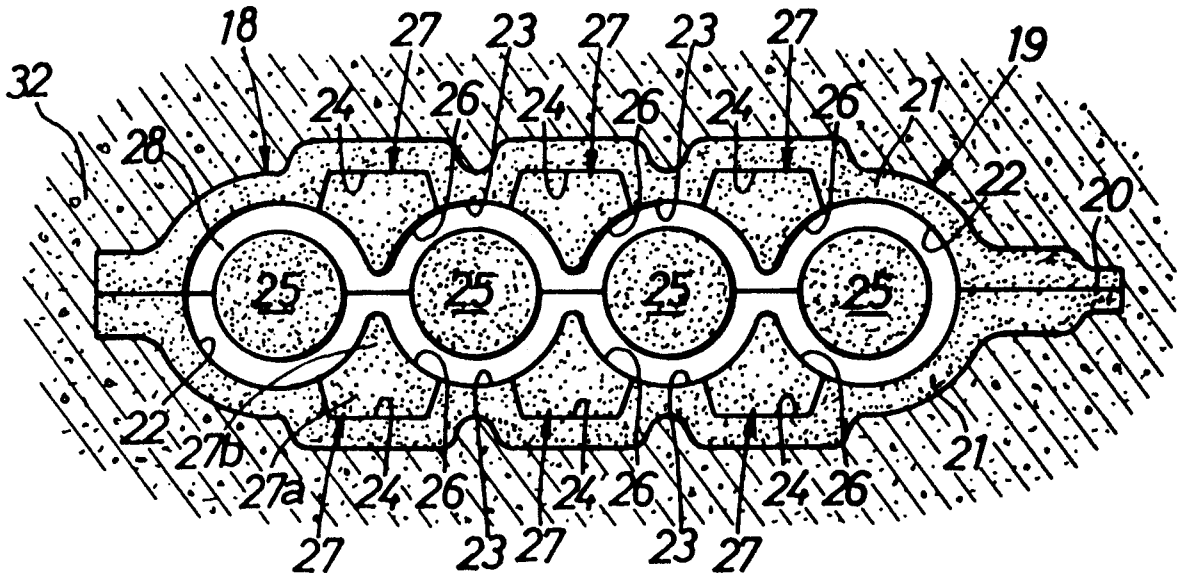
FIG. 7 is a plan view of a sand mold for casting a cylinder sleeve assembly.

The cylinder sleeve assembly 3 is cast using a sand mold 18 shown in FIG. 7. The sand mold 18 is formed from a resin sand.

A body 19 of the sand mold 18 is comprised of a pair of halves 21 which are symmetrical with each other with respect to a mating surface including the center line b of each cylinder bore 8. The sand mold body 19 includes a pair of major arc-shaped inner peripheral surfaces 22 located at opposite ends, two pairs of minor arc-shaped inner peripheral surfaces 23 located between both the major arc-shaped inner peripheral surfaces 22 with opposed two of these surfaces 23 constituting a pair, and six trapezoidal fitting grooves 24 connecting the adjacent major arc-shaped inner peripheral surface 22 and minor arc-shaped inner peripheral surface 23 with each other as well as the adjacent minor arc-shaped inner peripheral surfaces 23 with each other.

A cylinder bore shaping columnar sand core 25 is placed in each of spaces surrounded by each of the major arc-shaped inner peripheral surfaces 22 and in each of spaces between the opposed minor arc-shaped inner peripheral surfaces 23. A base end 27*a* of a fitting sand mold portion 27 is fitted into each of the grooves 24, and an angle portion 27*b* connected to the base end 27*a* and having an angle inner surface 26 corresponding to the valley-like area A of the cylinder sleeve assembly 3 protrudes from the fitting groove 24.

A cylinder sleeve assembly shaping cavity 28 is defined by cooperation of the sand mold body 19, the sand cores 25 and the fitting sand mold portions 27 in this manner. A plurality of concavities and a plurality of convexities (which are not shown in Figures) are provided in each of the major arc-shaped inner peripheral surfaces 22 and on each of the minor arc-shaped inner peripheral surfaces 23 to correspond to the concavities 13 and the convexities 10 of the cylinder sleeve assembly 3, respectively.

Figure 8:
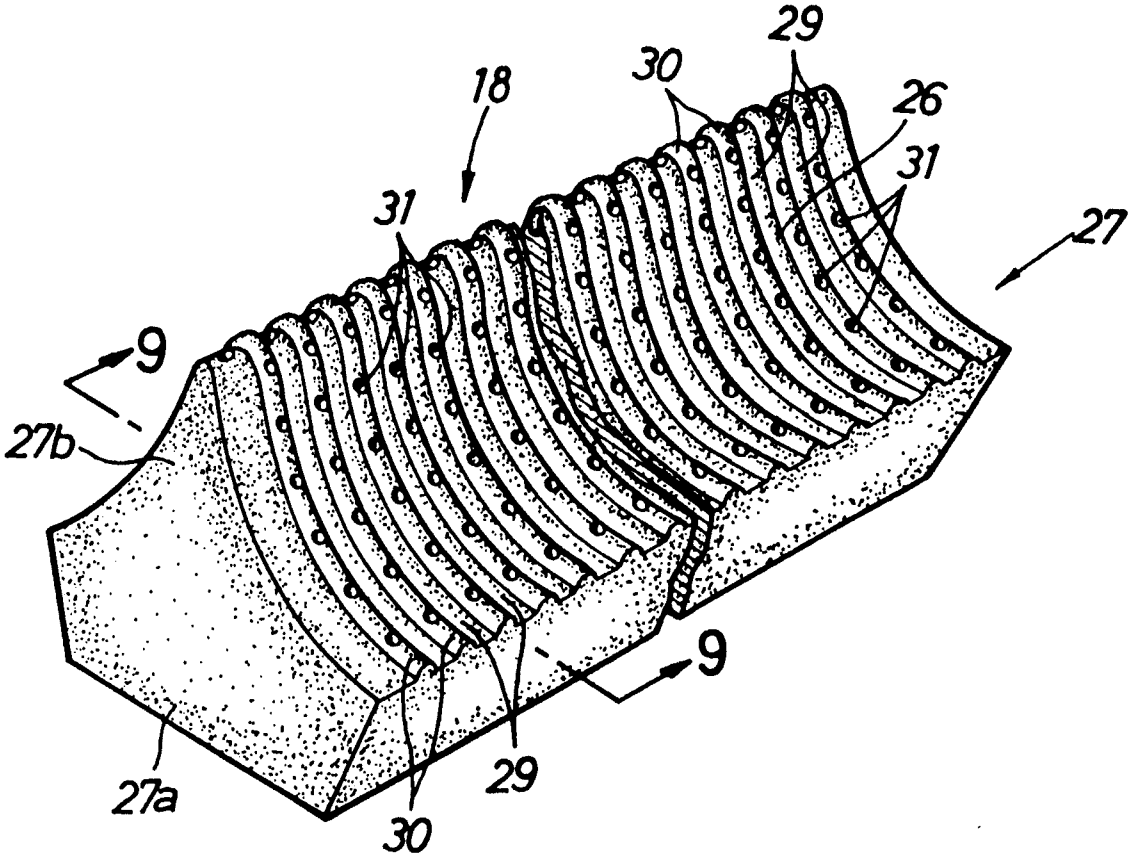
FIG. 8 is a perspective view of a fitting sand mold portion.
Figure 9:
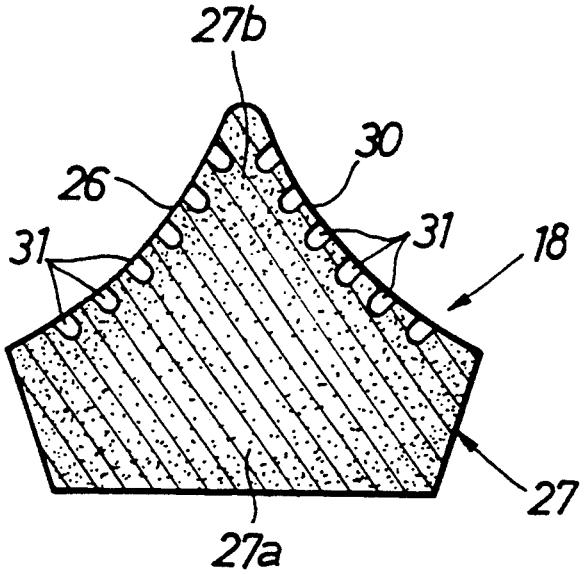
FIG. 9 is a sectional view taken along a line 9—9 in FIG. 8.

The angle inner surface 26 of each of the fitting sand mold portions 27 is provided with a plurality of concavities 29 and a plurality of convexities 30 corresponding to the concavities 13 and the convexities 10 of the cylinder sleeve assembly 3, and a plurality of recesses 31 disposed in each of the convexities 30 so as to shape the sink mark inhibiting projections 12 in a casting manner, as best shown in FIGS. 8 and 9.

Referring to FIG. 7, the sand mold 18 is reinforced by a back-up member 32 made of a gravel and located outside thereof.

If a molten metal consisting of a cast iron composition is poured into the cavity 28 in the sand mold 18, a cylinder sleeve assembly 3 shown in FIGS. 3 to 5 can be produced in a casting process.

The sand mold 18 is molded using forming molds shown in FIGS. 10 to 15, i.e., first and second forming molds 33 and 34 which are metal molds, and a forming core which is not shown.

Figure 10:
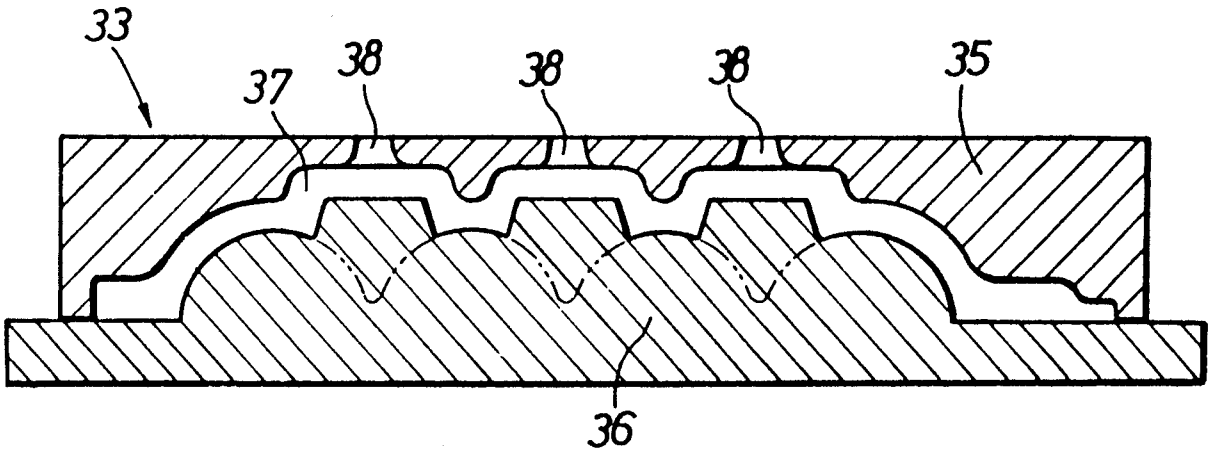
FIG. 10 is a longitudinal sectional front view of a first molding die for molding a half of a sand mold body.

FIG. 10 illustrates the first forming mold 33 for producing the half 21 of the sand mold body 19. The forming mold 33 is comprised of an upper die 35 and a lower die 36, so that a molding cavity 37 corresponding to the half 21 is defined by both the dies 35 and 36. The half 21 is molded by blowing a resin sand into the cavity 37 through each of blow-in ports 38 in the upper die 35.

FIGS. 11 to 15 illustrate the second forming mold 34 for producing the fitting sand mold portion 27 having the angle inner surface 26.

Figure 11:
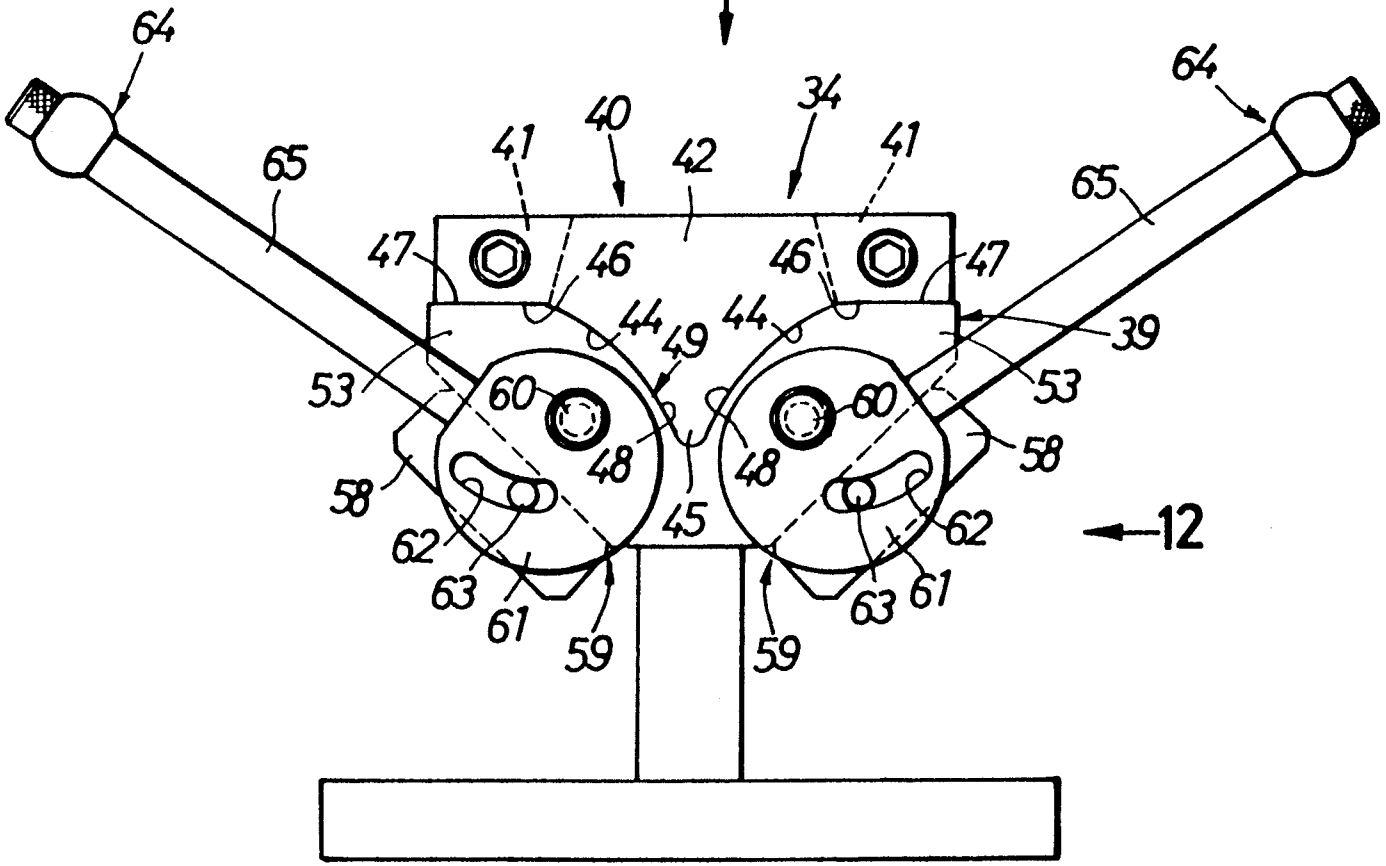
FIG. 11 is a front view of a second molding die for molding the fitting sand mold portions.
Figure 12:
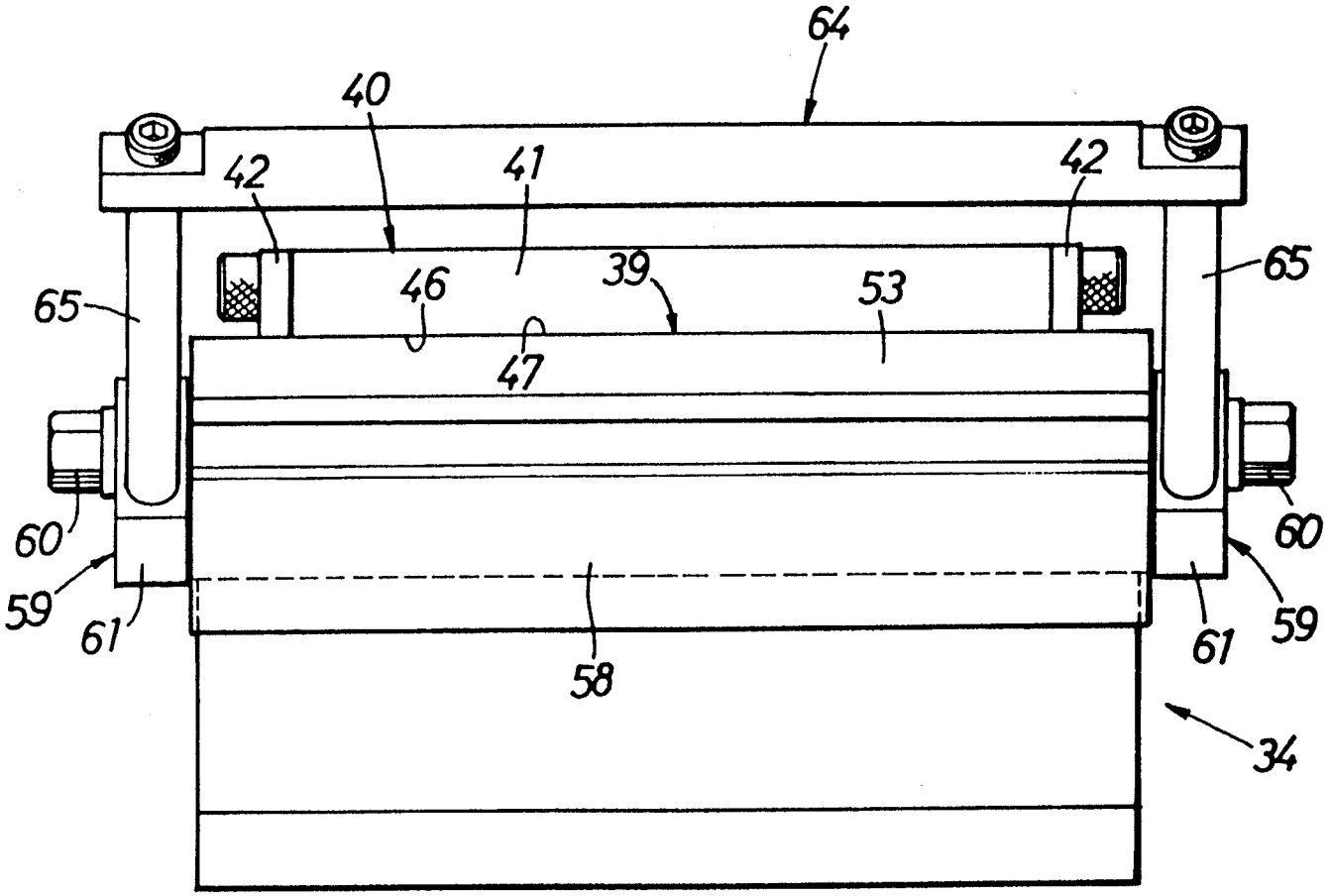
FIG. 12 is a view taken along an arrow 12 in FIG. 11.
Figure 13:
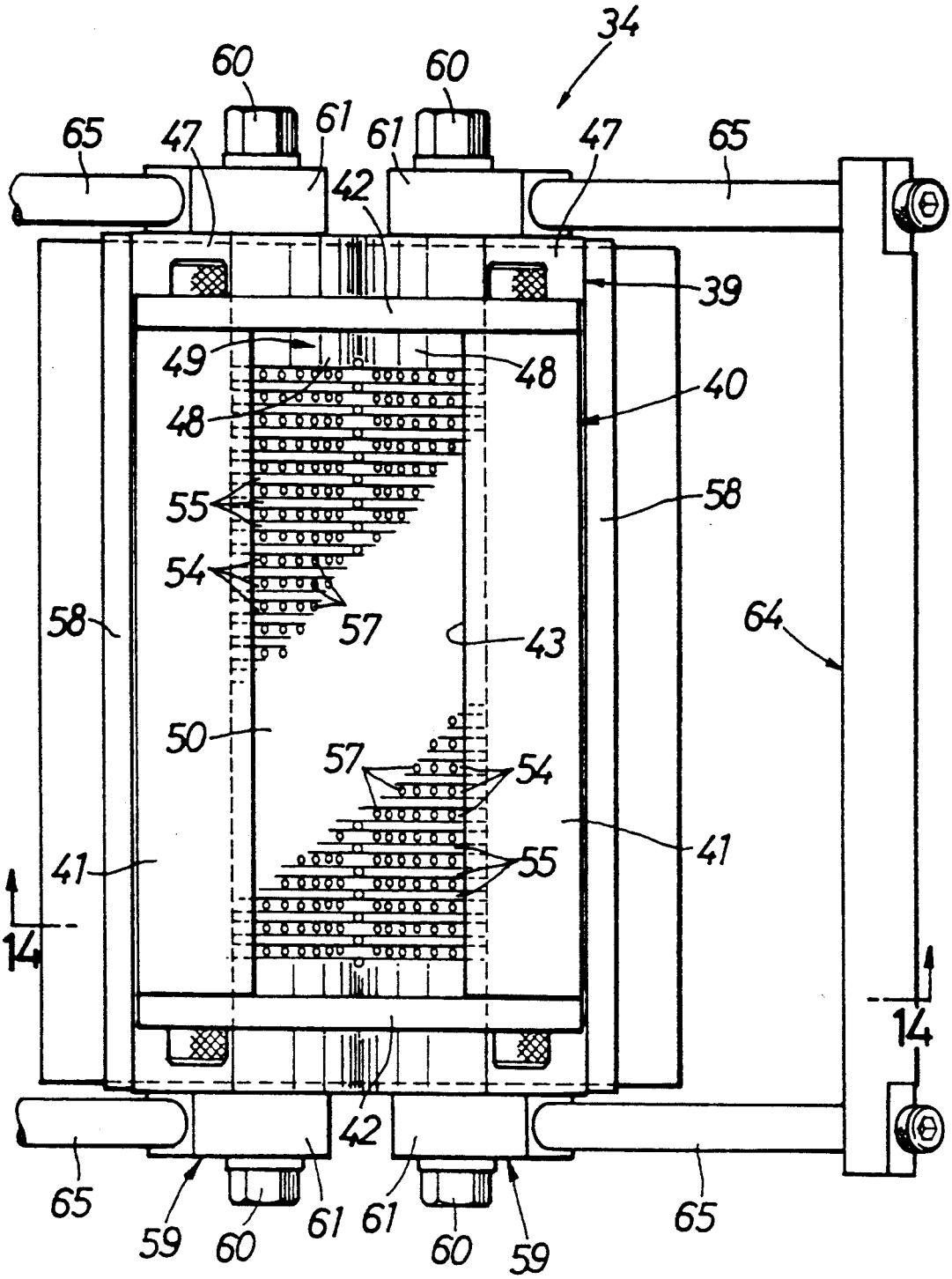
FIG. 13 is a view taken along an arrow 13 in FIG. 11.

As clearly shown in FIGS. 11 and 13, the second forming mold 34 is comprised of a stationary lower die (a mold-forming section) 39 and an upper die 40 attachable to and detachable from the lower die 39. A positioning means (not shown) is provided between both the dies 39 and 40. The upper die 40 comprises a pair of sidewalls opposed to each other at a predetermined distance, and a pair of end walls 42 mounted to opposite end faces of the sidewalls 41, and includes a resin sand charging port 43 defined by these walls 41 and 42 and opened upwardly. Each of the end walls 42 includes an angle portion 45 having a pair of recessedly arcuate slants 44. The angle portion 45 protrudes more downwardly than both the sidewalls 41. The lower die 39 is substantially V-shaped in cross section and includes a pair of upper surfaces 47 opposed to lower surfaces 46 of the sidewalls 41 of the upper die 40, and a valley-like surface 49 connected to both the upper surfaces 47 and having a pair of raisedly arcuate slants 48.

With the upper and lower dies 40 and 39 closed, the lower surfaces 46 of the sidewalls 41 in the upper die 40 are matched with the upper surfaces of the lower die 39, and the slants 44 of the angle portion 45 are matched with the slants 48 at longitudinally opposite ends of the valley-like surface 49 of the lower die 39. This causes a molding cavity 50 corresponding to the fitting sand mold portions 27 to be defined by inner surface of the sidewalls 41, inner surfaces of the end walls 42 and the valley-like surface of the lower die 39.

Figure 14:
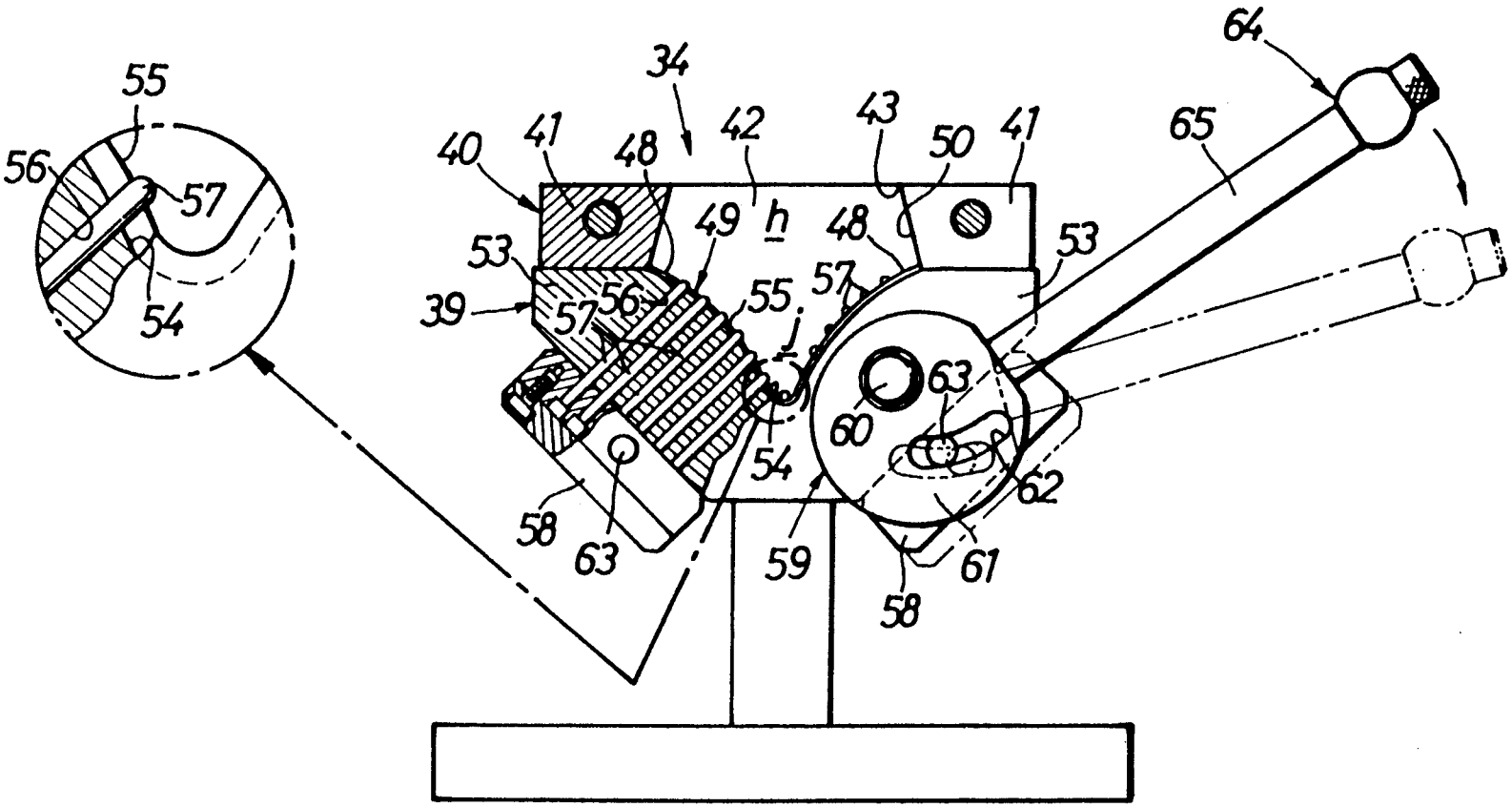
FIG. 14 is a sectional view taken along a line 14—14 in FIG. 13.

As best shown in FIG. 14, in the molding cavity 50, a trapezoidal area h in the upper die 40 is used to shape the base end 27*a* (see FIGS. 8 and 9) of the fitting sand mold portion 27 fitted in the receiving groove 24, and a valley-like area j in the lower die 39 is used to shape the angle portion 27*b* (see FIGS. 8 and 9) of the fitting sand mold portion 27 protruding from the receiving groove 24.

As best shown in FIG. 14, in the lower die 39, a lower die constituting section 53 defining each of the slants 48 of the valley-like surfaces 49 is provided with a plurality of concavities 54 and a plurality of convexities 55 corresponding to the recessed and convexities 29 and 30 of the fitting sand mold portion 27, and a plurality of through-holes 56 opened in the concavities 54 and corresponding to the projection casting or forming recesses 31 of the fitting sand mold portion 27.

Fin-like projecting portions 57 for shaping the recesses 31 are slidably fitted into the through-holes 56, respectively. In each of the lower die constituting sections 53, base ends of the projecting portions 57 are collectively retained on a holder 58 disposed on a back side of each of the lower die constituting sections 53. With each of the holder 58 mated with the back side of corresponding one of the lower die constituting sections 53, a tip or leading end of each of the projecting portions 57 protrudes substantially in a radial direction from corresponding one of the through-holes 56, wherein the length of such protrusion is equal to the depth of the projection forming recess 31.

As clearly shown in FIGS. 11 to 14, an operating mechanism 59 for allowing each of the projecting portions 57 to protrude and sink from and into the corresponding through-hole 56 is provided in each of the lower die constituting sections 53 in the following manner.

Support shafts 60 are projectingly mounted on opposite end faces of each of the lower die constituting sections 53 respectively to lie on the same axis, and a cam plate 61 is rotatably provided on each of the support shafts 60. Each of the cam plates 61 has an elongated arcuate hole 62, and an operating pin 63 is projectingly provided on an end face of the holder 58 and slidably received in the elongated hole 62. In each of the lower die constituting sections 53, parallel arms 65 of a-shaped operating handle 64 are connected to outer peripheries of the opposite cam plates to extend upwardly angularly, respectively.

As shown by a solid line in FIG. 14, when the operating handle 64 is in its upper position and the operating pin 63 is located in a portion of the elongated hole 62 closer to one end adjacent the support shaft 60, the holder 58 abuts against the back of the lower die constituting section 53, so that the tip or leading ends of the projecting portions 57 protrude from the corresponding through-holes 56. On the other hand, as shown by a dashed line in FIG. 14, when the operating handle 64 is in its upper position and the operating pin 63 is located in a portion of the elongated hole 62 closer to the other end farther from the support shaft 60, the holder 58 is spaced apart from the back of the lower die constituting section 53, so that the tip or leading ends of the projecting portions 57 sink into the corresponding through-holes 56.

Figure 15:
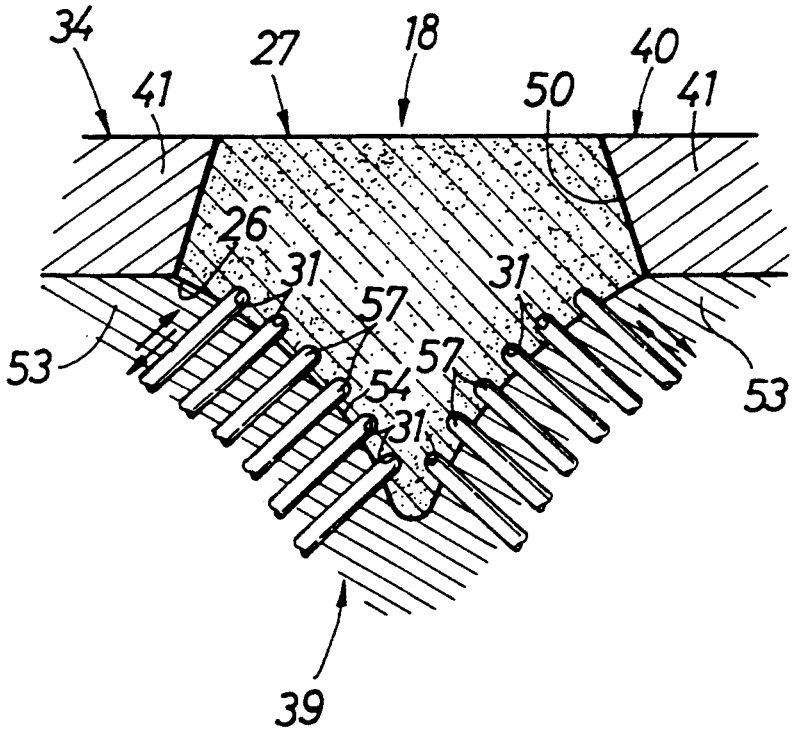
FIG. 15 is a view for explaining a step for molding the fitting sand mold portions.

In molding the fitting sand mold portion 27, the operating handle 64 is located at its lower position, causing the projecting portions 57 to sink into the corresponding through-holes 56. Then, a resin sand is charged through the charging port 43 into the cavity 50 and tamped therein to form a sand mold blank. Thereafter, the operating handle 64 is located at its upper position, with the tip or leading ends of the projecting portions 57 protruding from the corresponding through-holes 56, as shown by the solid line in FIG. 14. This causes the tip or leading ends of the projecting portions 57 to be forced into the angle inner surface of the sand mold blank, as shown in FIG. 15, thereby shaping the projection forming or casting recesses 31.

In case a plurality of projecting portions 57 are crowded, if the recesses 31 are shaped simultaneously with the molding of the sand mold portion 27 in a condition in which the tip or leading ends of the projecting portions 57 have protruded from the corresponding through-holes 56, then the resin sand may be not spread to the tip or leading ends of all the projecting portions 57, resulting in a defective product, in some cases. However, if the tip or leading ends of the projecting portions 57 are forced into the angle inner surface of the sand mold blank to shape the recesses 31, as described above, the recesses 31 can be shaped reliably and without getting out of shape. In releasing the fitting sand mold portions 27 from the mold, the operating handle 64 is located again in its lower position, and the projecting portions 57 are withdrawn from the corresponding recesses 31. Then, the upper die 40 is removed from the fitting sand mold portions 27, and thereafter, the fitting sand mold portions 27 are removed from the lower die 39. This enables the releasing of the fitting sand mold portions 27 to be conducted smoothly.

Figure 16:
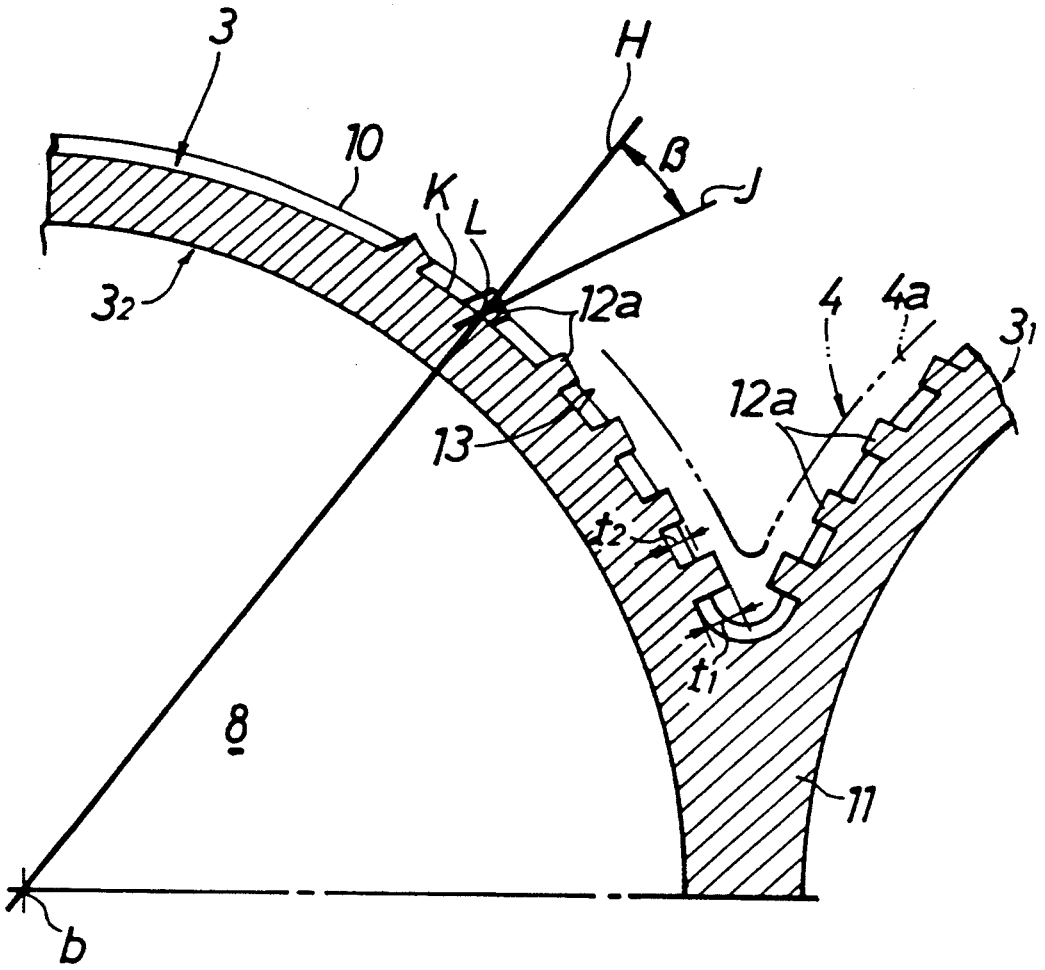
FIG. 16 is a view similar to the enlarged view of the encircled portion indicated by the arrow 5 in FIG. 3, but illustrating a first modification to the sink mark inhibiting engage portions.
Figure 17:
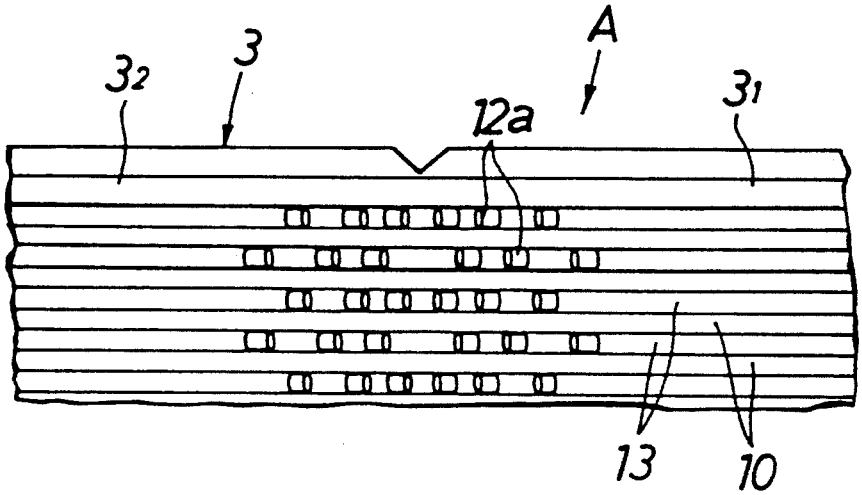
FIG. 17 is a side view of an essential portion of a cylinder sleeve assembly, illustrating a second modification to the sink mark inhibiting engage portions.
Figure 18:
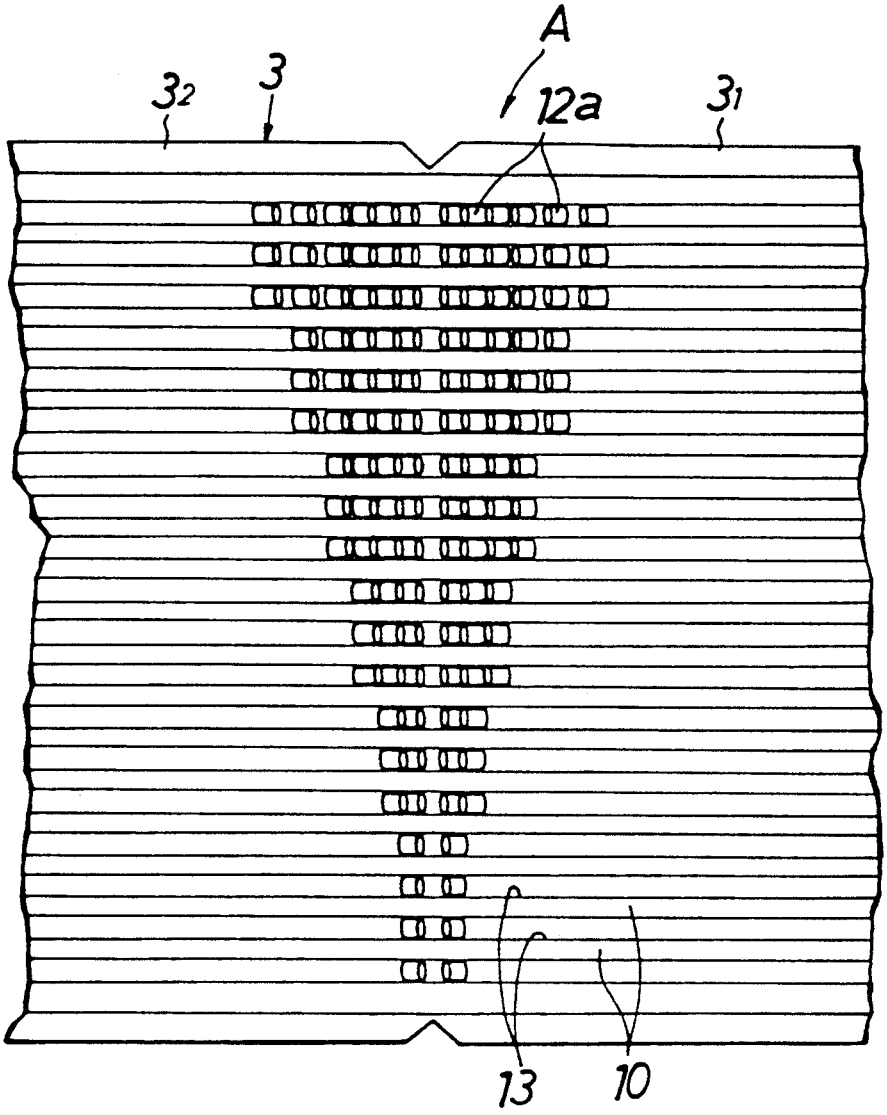
FIG. 18 is a side view of an essential portion of a cylinder sleeve assembly, illustrating a third modification to the sink mark inhibiting engage portions.

Alternatively, the projecting portions 57 may be fixed to each of the lower die constituting sections 53, and each of the lower die constituting sections 53 is moved to release the projecting portions 57 from the corresponding recesses 31. The present invention is also applicable to a mold for molding a sand mold 18 comprising a sand mold body 19 integral with fitting sand mold portions 27. FIGS. 16 to 18 illustrates a modification to the sink mark inhibiting engage portions disposed in the above-described valley-like area A.

As clearly shown in FIG. 16, each of projections 12*a* located in the valley-like area A is formed into a pin-like configuration having a predetermined inclined angle $\beta$ formed by a predetermined dividing plane J inclined toward the coupled portion 11 with respect to a reference plane H. Here, the term "predetermined dividing plane J" is defined as a plane intersecting a curvature circle K of the outer peripheral surface of the cylinder sleeve $3_2$ to bisect the pin-like projection 12*a* and extending in a direction of the axis b of the cylinder sleeve $3_2$. In addition, the term "reference plane H" is defined as a plane including the center of the curvature circle K and an intersection L of the dividing plane J with the curvature circle K and extending in the direction of the axis b of the cylinder sleeve $3_2$. In this embodiment, since the projection 12*a* is formed into the pin-like configuration, the dividing plane J is established to include an axis of the pin-like projection 12*a*. In addition, since the cylinder sleeve 32 is shaped cylindrically, the axis of the cylinder sleeve $3_2$ is matched with the center of the curvature circle K and hence, the curvature circle K and the outer peripheral surface (bottom surfaces of the recesses stripes 13) of the cylinder sleeve $3_2$ overlaps each other. By inclining the pin-like projection 12*a* in this manner, it is possible to exhibit a sink mark inhibiting effect more significantly.

In order to facilitate the molding of the casting mold for the cylinder sleeve assembly 3, all the pin-like projections 12*a* located on the slant on each side of the valley-like area A may be formed so that their axes are parallel to one another. In this case, the dividing plane and the reference plane in the pin-like projection 12*a* nearest to the coupled portion 11 may be matched with each other.

The amount $t_1$ of protrusion of the pin-like projection 12*a* located nearer to the coupled portion 11 than the tip or leading end of the V-shaped portion 4*a* of the cylinder barrel assembly 4, i.e., the pin-like projection 12*a* nearest to the coupled portion 11 in the illustrated embodiment from the outer peripheral surface (the bottom surfaces of the concavities 12) of the cylinder sleeve $3_2$ is set larger than the amount of protrusion of the pin-like projections 12 located at the other places. This ensures that an opposing force by the pin-like projection 12*a* against the solidification/shrinkage force is exhibited sufficiently at the tip or leading end of the V-shaped portion 4*a* of the cylinder barrel assembly 4 where a sink mark is otherwise generated most easily.

Not only pin-like projections 12*a* may be disposed in a uniformly dispersed manner in the valley-like area A, as shown in FIG. 4, but also such pin-like projections 12*a* may be disposed in a zigzag manner as viewed in a plane on the outer peripheral surface of the cylinder sleeve assembly 3 to lie on the bottom surfaces of the concavities 13 adjoining the convexities 10, as shown in FIG. 17. In addition, the pin-like projections 12*a* may be disposed so that the density of disposition is smaller at a lower portion of the cylinder sleeve $3_1$ ($3_2$), as shown in FIG. 18. Reversely, the pin-like projections 12*a* may be disposed so that the density of disposition is larger at a lower portion of the cylinder sleeve $3_1$ ($3_2$). By disposing the pin-like projections 12*a* in the zigzag manner or varying the density of disposition of the pin-like projections 12*a* in the above manner, it is possible to provide a sink mark inhibiting effect similar to that described above by a smaller number of projections. Further, it is also possible to properly combine the zigzag disposition and the variation in density of disposition.

Figure 19:
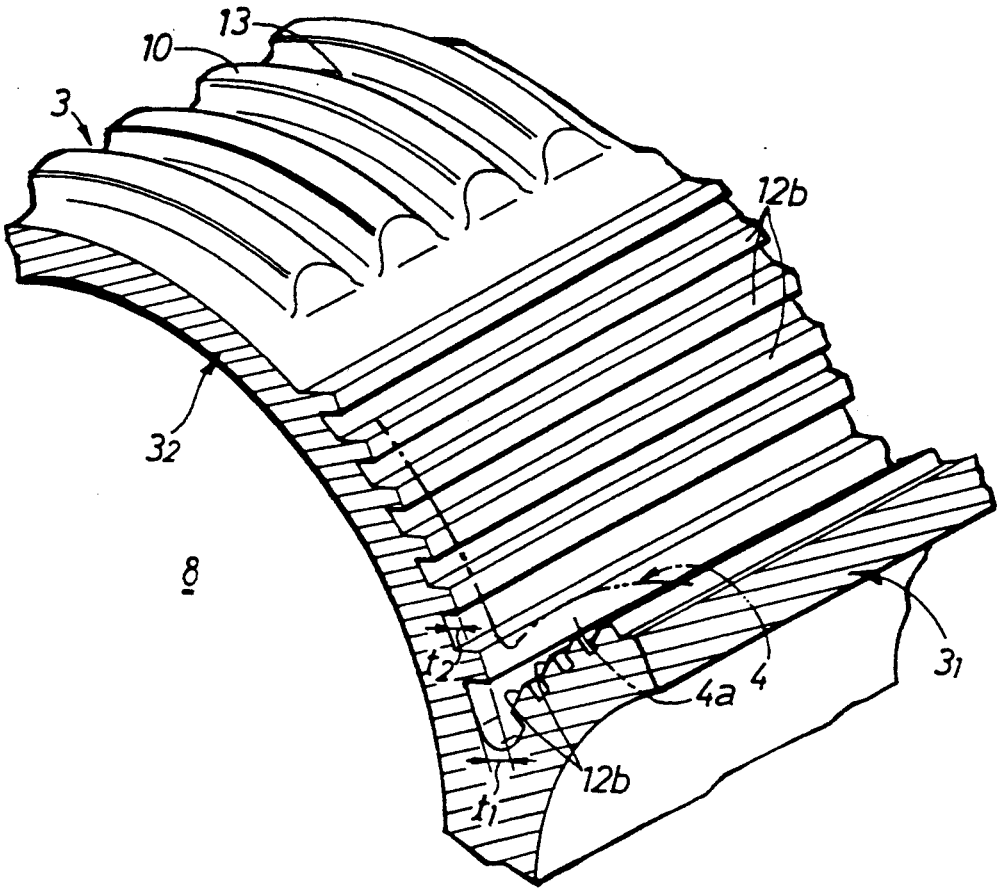
FIG. 19 is a view similar to the enlarged perspective view of the encircled portion indicated by the arrow 5 in FIG. 3, but illustrating a fourth modification to the sink mark inhibiting engage portions.
Figure 20:
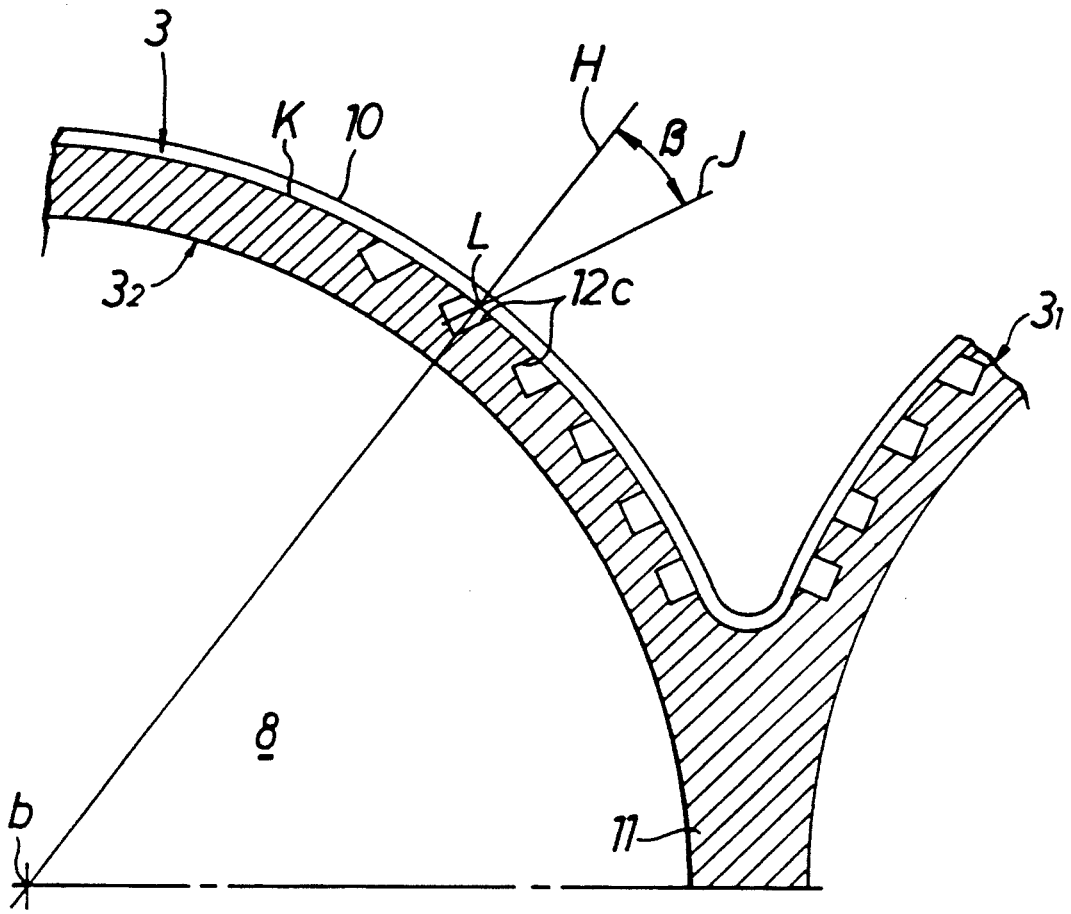
FIG. 20 is a view similar to the enlarged view of the encircled portion indicated by the arrow 5 in FIG. 3, but illustrating a fifth modification to the sink mark inhibiting engage portions.
Figure 21:
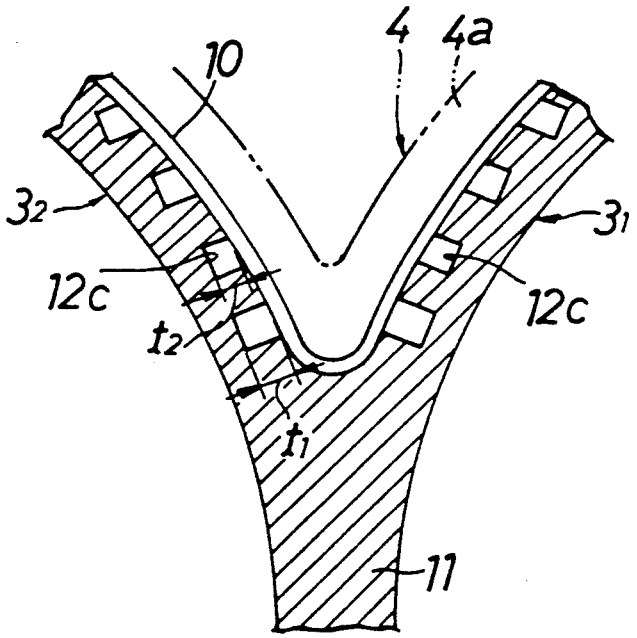
FIG. 21 is a sectional view of a portion corresponding to the essential portion in FIG. 20, but illustrating a sixth modification to the sink mark inhibiting engage portions.
Figure 22:
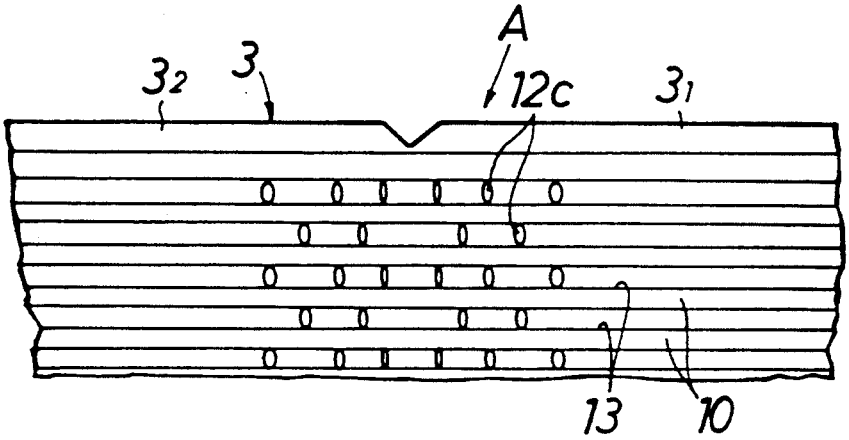
FIG. 22 is a side view of an essential portion of a cylinder sleeve assembly, illustrating a seventh modification to the sink mark inhibiting engage portions.
Figure 23:
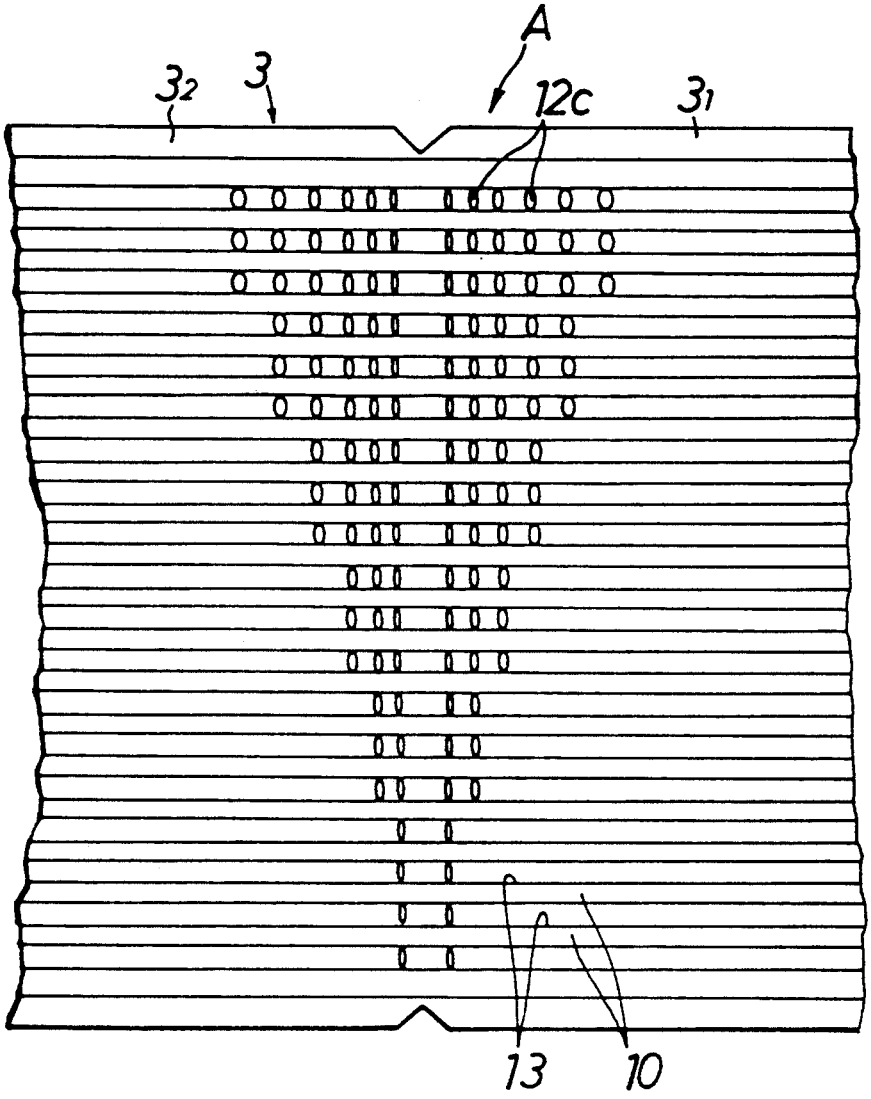
FIG. 23 is a side view of an essential portion of a cylinder sleeve assembly, illustrating an eighth modification to the sink mark inhibiting engage portions.

FIG. 19 illustrates another modification to the sink mark inhibiting engage portions. In this modification, the engage portions are formed into a plurality of convexities 12*b* extending along a generating line of the each of the cylinder sleeves $3_1$, $3_2$, $3_3$ and $3_3$ and having a predetermined inclined angle $\beta$. In this case, the horizontal convexities 10 in the valley-like area A are eliminated. Even in this modification, an opposing force is exhibited at the tip or leading end of the V-shaped portion 4*a* of the cylinder barrel assembly 4 by differing the protrusion amounts $t_1$ and $t_2$ from each other, as described above. FIGS. 20 to 23 illustrate a further modification to the sink mark inhibiting engage portions. In this modification, the engage portions are formed into dimples 12*c* having a predetermined inclined angle $\beta$. All the dimples 12*c* may be formed with the same depth, as shown in FIG. 20, but also the dimple 12*c* nearest to the coupled portion 11 may be formed with a depth $t_1$ larger than those $t_2$ of the dimples 12*c* located at the other places, thereby providing an increased sink mark inhibiting effect. In addition, the dimples may be disposed in a uniformly dispersed manner in the valley-like area A, as are the above-described pin-like projections 12*a*, but also the dimples 12*c* may be disposed in a zigzag manner (see FIG. 22), and the dimples 12*c* may be disposed with densities differed from one another place by place (see FIG. 23). Alternatively, it is properly possible to combine these dispositions.

Figure 24:
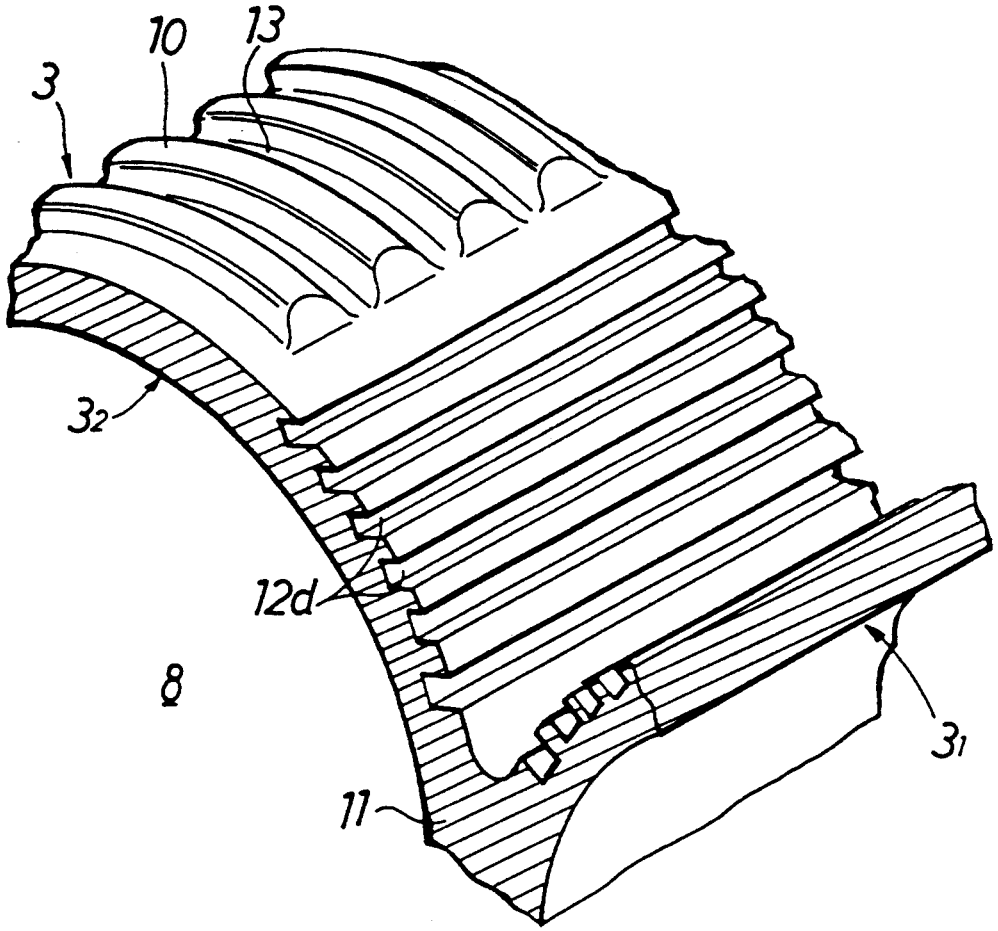
FIG. 24 is a view similar to the enlarged perspective view of the encircled portion indicated by the arrow 5 in FIG. 3, but illustrating a ninth modification to the sink mark inhibiting engage portions.

FIG. 24 illustrates a yet further modification to the sink marl inhibiting engage portions. In this modification, the engage portions are formed into a plurality of concavities 12*d* extending along a generating line of each of the cylinder sleeves $3_1$, $3_2$, $3_3$ and $3_3$ and having a predetermined inclined angle $\beta$. In this case, the horizontal convexities 10 in the valley-like area A are eliminated. Even in this modification, an increase in sink mark inhibiting effect can be provided by differing the depths, as described above.

Figure 25:
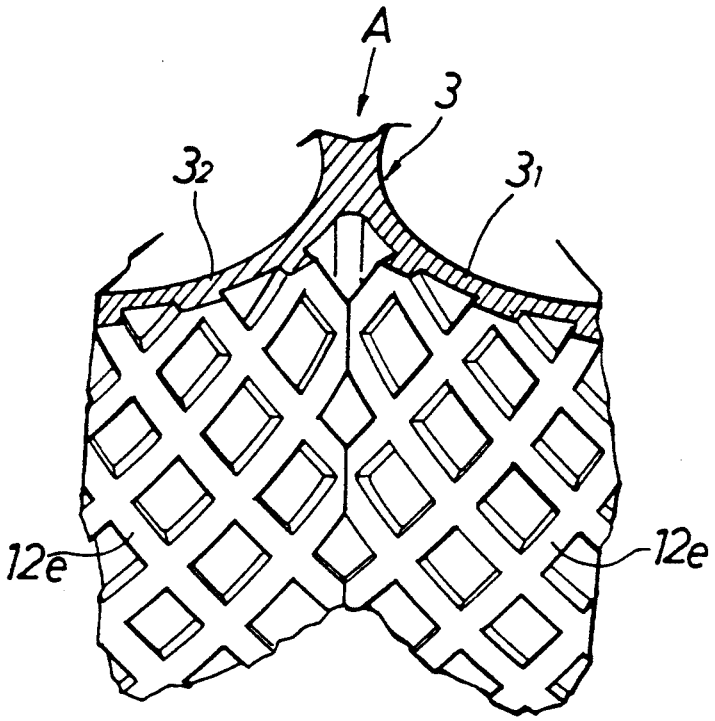
FIG. 25 is a view similar to the enlarged perspective view of the encircled portion indicated by the arrow 5 in FIG. 3, but illustrating a tenth modification to the sink mark inhibiting engage portions.
Figure 26:
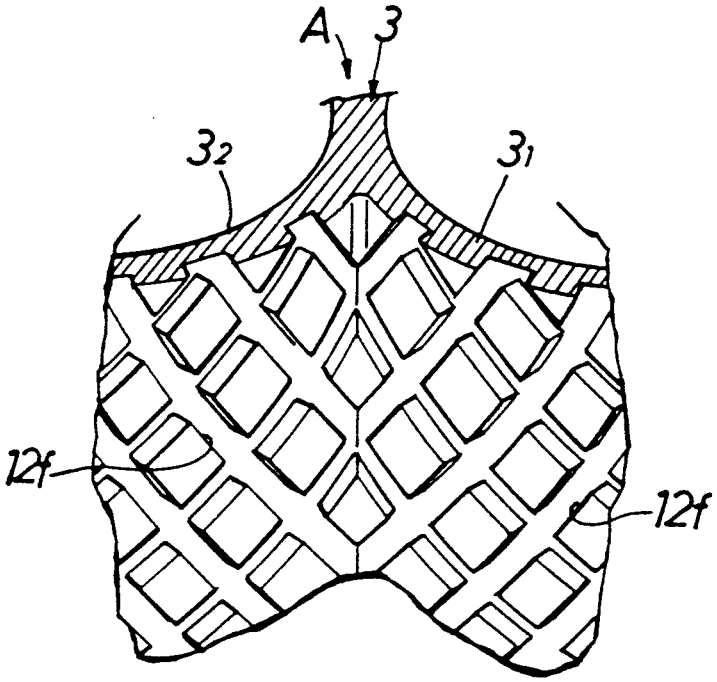
FIG. 26 is a view similar to the enlarged perspective view of the encircled portion indicated by the arrow 5 in FIG. 3, but illustrating an eleventh modification to the sink mark inhibiting engage portions.

FIG. 25 illustrates a yet further modification to the sink mark inhibiting engage portions. In this modification, the engage portions are formed into a plurality of convexities 12*e* intersecting one another to form meshes on the outer peripheral surface of each of the cylinder sleeves $3_1$, $3_2$, $3_3$ and $3_3$. As shown in FIG. 26, the convexities can be replaced by concavities 12*f*.

Figure 27:
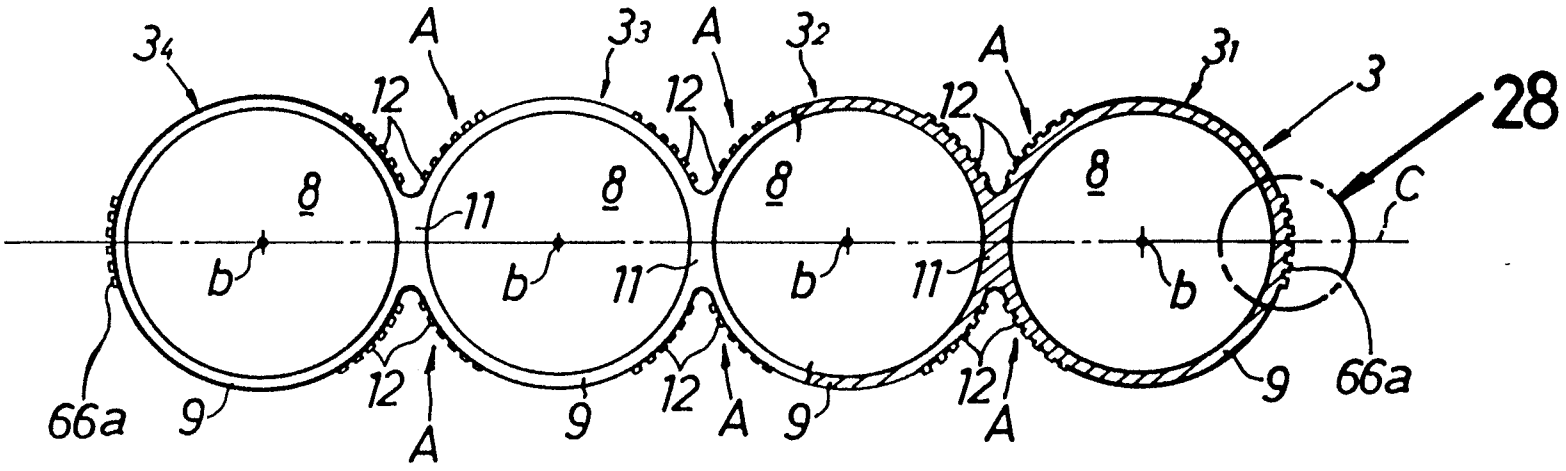
FIG. 27 is a broken plan view of an essential portion of a cylinder sleeve assembly according to another embodiment.
Figure 28:
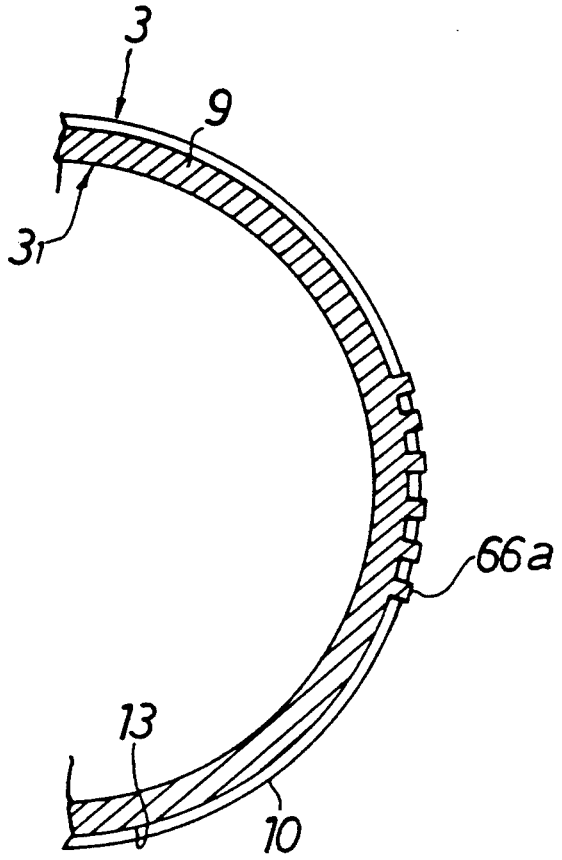
FIG. 28 is an enlarged view of an encircled portion indicated by an arrow 28 in FIG. 27.

FIGS. 27 and 28 illustrate an embodiment in which in addition to the sink mark inhibiting engage portions 12, 12*a* to 12*f* in the above-described valley-like area A, a plurality of sink mark inhibiting engage portions are provided in opposite end areas in a direction of arrangement of the cylinder sleeves $3_1$, $3_2$, $3_3$ and $3_4$, i.e., in a direction along a plane C. In this embodiment, portions or components corresponding to those in the previous embodiment are designated by the same reference characters, and the detailed description of them is omitted herein.

As clearly shown in FIGS. 27 and 28, each of the sink mark inhibiting engage portions in the opposite end areas in the direction arrangement of the cylinder sleeves $3_1$, $3_2$, $3_3$ and $3_4$ is formed into a pin-like projection 66*a*. Each of the pin-like projections 66*a* protrudes in a radial direction from a bottom surface of each concavities 13, with a tip or leading end of each projection 66*a* located more radially outwardly than each convexity 10. During casting of the cylinder block 1, these pin-like projections 66*a* are brought into engagement with the cylinder barrel assembly 4 to prevent sink marks from being produced in the cylinder barrel assembly 4 and to contribute to the uniformization of the stress generated during cooling. Alternatively, the pin-like projections 66*a* may be disposed in a zigzag manner as viewed in a plane, or may be disposed at properly varied densities.

Figure 29:
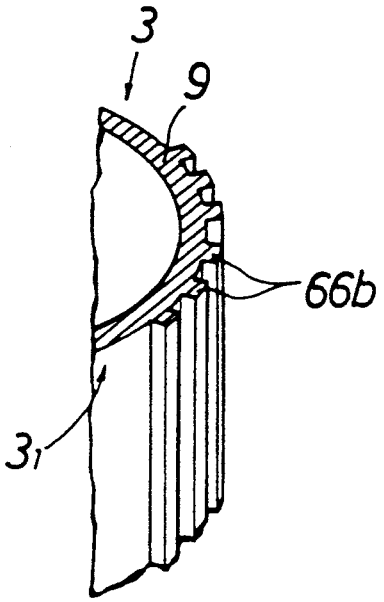
FIG. 29 is a view similar to the enlarged perspective view of the encircled portion indicated by the arrow 28 in FIG. 27, but illustrating a first modification to the sink mark inhibiting engage portions.
Figure 30:
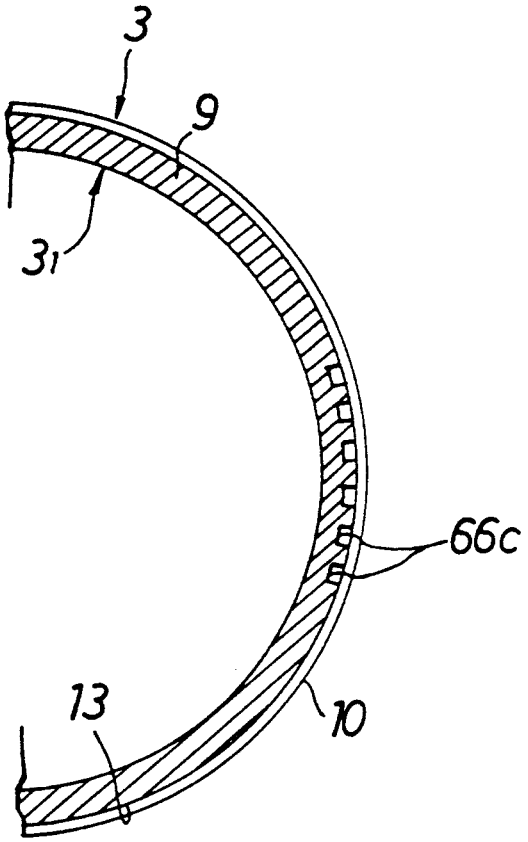
FIG. 30 is a view similar to the enlarged perspective view of the encircled portion indicated by the arrow 28 in FIG. 27, but illustrating a second modification to the sink mark inhibiting engage portions.
Figure 31:
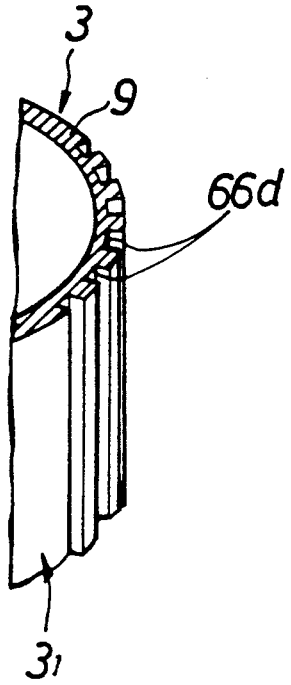
FIG. 31 is a view similar to the enlarged perspective view of the encircled portion indicated by the arrow 28 in FIG. 27, but illustrating a third modification to the sink mark inhibiting engage portions.

As shown in FIGS. 29 to 31, the sink mark inhibiting engage portions located at the opposite end areas may be formed into convexities 66*b*, dimples 66*c* or concavities 66*d*, in place of the above-described pin-like projections 66*a*. In such case, the sink mark inhibiting engage portions in the valley-like area A may be in any form selected from the above-described pin-like projections, convexities and the like. However, even if the pin-like projections are used in the valley-like area, the pin-like projections need not necessarily be used in the opposite end areas, and for the sink mark inhibiting engage portions in the valley-like area and the opposite end areas, any forms may freely used in combination.

It should be noted that in any of the above-described embodiments, the sink mark inhibiting engage portions are formed simultaneously with the casting of the cylinder sleeve assembly 3, but include those formed by coating.

What is claimed is:

1. A cylinder sleeve assembly cast in a cylinder barrel assembly in a cylinder block for a multi-cylinder internal combustion engine, comprising a plurality of cylinder sleeves whose adjacent cylindrical peripheral walls are coupled to each other, and a plurality of sink mark inhibiting engaging portions provided in each valley-like area of an outer peripheral surface of the cylinder sleeve assembly which is located on opposite sides of a coupled portion between the adjacent cylindrical peripheral walls, said sink mark inhibiting engaging portions being engaged with said cylinder barrel assembly during casting of said cylinder block.

2. A cylinder sleeve assembly cast in a cylinder barrel assembly in a cylinder block for a multi-cylinder internal combustion engine, comprising a plurality of cylinder sleeves whose adjacent cylindrical peripheral walls are coupled to each other, and a plurality of sink mark inhibiting engaging portions provided in each valley-like area of an outer peripheral surface of the cylinder sleeve assembly which is located on opposite sides of a coupled portion between the adjacent cylindrical peripheral walls, said sink mark inhibiting engaging portions being engaged with said cylinder barrel assembly during casting of said cylinder block, said engaging portion being formed in such a manner that an engaging portion-bisecting division plane which intersects a curvature circle of the outer peripheral surface of the cylinder sleeve and extends in an axial direction of the cylinder sleeve, has a predetermined inclined angle inclined toward said coupled portion with respect to a reference plane which includes an intersection between said division plane and the curvature circle and the center of the curvature circle and extends in the axial direction of the cylinder sleeve.

3. A cylinder sleeve assembly used in a cylinder block for a multi-cylinder internal combustion engine according to claim I or 2, wherein said sink mark inhibiting engaging portions are pin-like projections.

4. A cylinder sleeve assembly used in a cylinder block for a multi-cylinder internal combustion engine according to claim 3, wherein said pin-like projections are disposed in a zigzag manner on the outer peripheral surface of the cylinder sleeve assembly.

5. A cylinder sleeve assembly used in a cylinder block for a multi-cylinder internal combustion engine according to claim 3, wherein the amount of protrusion of said pin-like projections from the outer peripheral surface of the cylinder sleeve assembly is varied.

6. A cylinder sleeve assembly used in a cylinder block for a multi-cylinder internal combustion engine according to claim 3, wherein the density of pin-like projections disposed on the outer peripheral surface of the cylinder sleeve assembly is varied.

7. A cylinder sleeve assembly used in a cylinder block for a multi-cylinder internal combustion engine according to claim I or 2, wherein said sink mark inhibiting engaging portions are convexities.

8. A cylinder sleeve assembly used in a cylinder block for a multi-cylinder internal combustion engine according to claim 7, wherein the amount of protrusion of said convexities from the outer peripheral surface of the cylinder sleeve assembly is varied.

9. A cylinder sleeve assembly used in a cylinder block for a multi-cylinder internal combustion engine according to claim 7, wherein said convexities are disposed to intersect one another so as to form meshes on the outer peripheral surface of the cylinder sleeve assembly.

10. A cylinder sleeve assembly used in a cylinder block for a multi-cylinder internal combustion engine according to claim I or 2, wherein said sink mark inhibiting engaging portions are dimples.

11. A cylinder sleeve assembly used in a cylinder block for a multi-cylinder internal combustion engine according to claim 10, wherein said dimples are disposed in a zigzag manner on the outer peripheral surface of the cylinder sleeve assembly.

12. A cylinder sleeve assembly used in a cylinder block for a multi-cylinder internal combustion engine according to claim 10, wherein the depth of said dimples is varied.

13. A cylinder sleeve assembly used in a cylinder block for a multi-cylinder internal combustion engine according to claim 10, wherein the density of dimples disposed on the outer peripheral surface of the cylinder sleeve assembly is varied.

14. A cylinder sleeve assembly used in a cylinder block for a multi-cylinder internal combustion engine according to claim I or 2, wherein said sink mark inhibiting engaging portions are concavities.

15. A cylinder sleeve assembly used in a cylinder block for a multi-cylinder internal combustion engine according to claim 14, wherein the depth of said concavities is varied.

16. A cylinder sleeve assembly used in a cylinder block for a multi-cylinder internal combustion engine according to claim 14, wherein said concavities are disposed to intersect one another so as to form meshes on the outer peripheral surface of the cylinder sleeve assembly.

17. A cylinder sleeve assembly cast in a cylinder barrel assembly in a cylinder block for a multi-cylinder internal combustion engine, comprising a plurality of cylinder sleeves whose adjacent cylindrical peripheral walls are coupled to each other, a plurality of first sink mark inhibiting engaging portions provided in each valley-like area of an outer peripheral surface of the cylinder sleeve assembly which is located on opposite sides of a coupled portion between the adjacent cylindrical peripheral walls, said first sink mark inhibiting engaging portions being engaged with said cylinder barrel assembly during casting of said cylinder block, and a plurality of second sink mark inhibiting engaging portions provided in opposite end areas of the outer peripheral surface of the cylinder sleeve assembly in a direction of arrangement of the cylinder sleeves, said second sink mark inhibiting engaging portions being engaged with said cylinder barrel assembly during casting of said cylinder block.

18. A cylinder sleeve assembly cast in a cylinder barrel assembly in a cylinder block for a multi-cylinder internal combustion engine, comprising a plurality of cylinder sleeves whose adjacent cylindrical peripheral walls are coupled to each other, a plurality of first sink mark inhibiting engaging portions provided in each valley-like area of an outer peripheral surface of the cylinder sleeve assembly which is located on opposite sides of a coupled portion between the adjacent cylindrical peripheral walls, said first sink mark inhibiting engaging portions being engaged with said cylinder barrel assembly during casting of said cylinder block, said first engaging portion being formed in such a manner that an engaging portion-bisecting division plane which intersects a curvature circle of the outer peripheral surface of the cylinder sleeve and extends in an axial direction of the cylinder sleeve, has a predetermined inclined angle inclined toward the coupled portion with respect to a reference plane which includes an intersection between said division plane and the curvature circle and the center of the curvature circle and extends in the axial direction of the cylinder sleeve, and a plurality of second sink mark inhibiting engaging portions provided in opposite end areas of the outer peripheral surface of the cylinder sleeve assembly in a direction of arrangement of the cylinder sleeves, said second sink mark inhibiting engaging portions being engaged with said cylinder barrel assembly during casting of said cylinder block.

19. A cylinder sleeve assembly used in a cylinder block for a multi-cylinder internal combustion engine according to claim 17 or 18, wherein said second sink mark inhibiting engaging portions are pin-like projections.

20. A cylinder sleeve assembly used in a cylinder block for a multi-cylinder internal combustion engine according to claim 17 or 18, wherein said second sink mark inhibiting engaging portions are convexities.

21. A cylinder sleeve assembly used in a cylinder block for a multi-cylinder internal combustion engine according to claim 17 or 18, wherein said second sink mark inhibiting engaging portions are dimples.

22. A cylinder sleeve assembly used in a cylinder block for a multi-cylinder internal combustion engine according to claim 17 or 18, wherein said second sink mark inhibiting engaging portions are concavities.

23. A forming mold for producing a sand mold for casting a cylinder sleeve assembly comprising a plurality of cylinder sleeves whose adjacent cylindrical-peripheral walls are coupled to each other, so that said cylinder sleeve assembly is cast in a cylinder barrel assembly, and a plurality of sink mark inhibiting projections provided in each valley-like area of an outer peripheral surface of the cylinder sleeve assembly which is located on opposite sides of a coupled portion of the adjacent cylindrical peripheral walls, so as to protrude substantially in a radial direction from each of the cylindrical peripheral walls, said sink mark inhibiting projections biting into said cylinder barrel assembly during casting of said cylinder block, said forming mold further comprising a forming mold constituting section for shaping an angled inner surface of the sand mold corresponding to said valley-like area, said forming mold constituting section having a plurality of projecting portions provided thereon for shaping a plurality of projection casting recesses in said angled inner surface, said projecting portions being adapted to be released from the recesses prior to the releasing of the sand mold.

* * * * *